US006790398B1

(12) United States Patent
Ejima et al.

(10) Patent No.: US 6,790,398 B1
(45) Date of Patent: Sep. 14, 2004

(54) ELASTIC DOLL AND METHOD FOR MANUFACTURING SAME

(75) Inventors: Takio Ejima, Chiba (JP); Hirokazu Matsuoka, Saitama (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 09/700,937

(22) PCT Filed: Aug. 23, 1999

(86) PCT No.: PCT/JP99/04526

§ 371 (c)(1),
(2), (4) Date: Nov. 21, 2000

(87) PCT Pub. No.: WO00/10665

PCT Pub. Date: Mar. 2, 2000

(30) Foreign Application Priority Data

| | | |
|---|---|---|
| Aug. 25, 1998 | (JP) | 10/238337 |
| Mar. 30, 1999 | (JP) | 11/089737 |
| Jul. 30, 1999 | (JP) | 11/216424 |

(51) Int. Cl.[7] ..... B29C 45/14

(52) U.S. Cl. ..... 264/251; 264/254; 264/255; 264/275; 264/293; 264/328.8

(58) Field of Search ..... 264/251, 254, 264/275, 293, 328.8, 345, 255; 425/DIG. 249

(56) References Cited

U.S. PATENT DOCUMENTS

| | | | | |
|---|---|---|---|---|
| 3,284,947 A | * | 11/1966 | Dahl | 46/156 |
| 3,624,691 A | * | 11/1971 | Robson | 46/162 |
| 4,068,702 A | * | 1/1978 | Herold | 164/30 |
| 4,932,919 A | * | 6/1990 | Shapero | 446/374 |

* cited by examiner

*Primary Examiner*—Edmund H. Lee

(57) ABSTRACT

An elastic doll capable of being bent at sites therein which are to be bent and kept from being bent at sites therein which are not to be bent, to thereby be deformed in a natural manner and capable of being downsized. The elastic doll includes a trunk (1), arms (2) and legs (3) in which a skeleton member (7) is embedded. The skeleton member (7) is constituted by first cores (8) made of metal and arranged at sites in the doll corresponding to joints and second cores made of rigid synthetic resin and arranged at sites in the doll corresponding to distal ends thereof and positions between joints adjacent to each other. The first cores (8) and second cores (9) are connected to each other, wherein the first cores (8) are covered with synthetic resin (6*a*) as required. The skeleton member (7) is covered with a skin/flesh member (6) made of soft synthetic resin.

22 Claims, 21 Drawing Sheets

ELASTIC DOLL AND METHOD FOR MANUFACTURING SAME

TECHNICAL FIELD

This invention relates to an elastic doll bendable at predetermined sites therein and a method for manufacturing the same, and more particularly to an elastic doll which has a skeleton embedded therein and is constructed to be bent at only joints and a method for manufacturing the same.

BACKGROUND ART

Conventionally, a dress-up doll which is adapted to be bendable at arms and legs, resulting in the doll being deformed into a variety of desired figures and which is permitted to put on various dresses for enjoyment has been accepted by girls. The doll is typically constructed in such a manner as shown in FIG. 1A. More specifically, it includes a trunk 120, and arms 121 and legs 122 pivotally connected to the trunk 120. The arms 121 are each formed so as to be bendable about an elbow 123 and the legs 122 are each formed to be bendable about a knee 124.

When the conventional doll thus constructed is formed in imitation of a girl, wearing of long-sleeved clothes on the doll permits bent portions of the doll such as shoulders and knees to be out of sight. However, when the doll has a skirt worn thereon, it fails to keep the knees from sight, so that joints of the knees 124 are externally exposed as shown in FIG. 1B, resulting in the doll being rendered unnatural. In order to eliminate such a problem, an elastic doll which is made of an elastic synthetic resin material and constructed so as to prevent exposure of joints was proposed. The elastic doll includes a trunk, arms, legs and a head detachably supported on the trunk and has a metal core (wire) embedded therein. More particularly, such an elastic doll, as disclosed in Japanese Patent Application Laid-Open Publication No. 35277/1988, is so configured that legs or arms each include an outer skin layer and a soft resin layer arranged in the outer skin layer. Also, a flexible core such as a wire is embedded in the soft resin layer. Such construction permits plastic deformation of the internal core, so that the elastic doll may be bent at a part of a body thereof like the human body and kept bent. Thus, the doll is held bent while permitting a surface of the doll to be soft, to thereby exhibit enhanced reality.

Unfortunately, the conventional elastic doll, when the core or wire is re-bent into an inverted dog-legged shape after it is bent into a dog-legged shape, causes both bending operations to be generally carried out at different sites therein rather than the same site. Thus, a portion of the elastic doll bent once is not restored to its former state by the re-bending operation, resulting in the portion being kept bent. The fact that the bending and re-bending are carried out at different sites causes problems such as unnatural operation of the doll, deformation of arms, a variation in length thereof and the like. Further, direct bending of the metal core such as a wire or the like causes it to be bent at an acute angle into a sharp shape such as an L-shape or a V-shape, unlike a core made of synthetic resin. Thus, stress is concentrated at only the bent portion, leading to possible breakage of the core. Breakage of the core in the elastic doll causes an end of the core to possibly break through a skin/flesh member of the elastic doll, to thereby be externally exposed, leading to damage to the human body. Also, the conventional elastic doll is unnatural because it causes sites therein other than joints to be unintendedly bent.

Insert molding of such an elastic doll causes holding of the core at a center in a mold to be highly difficult. The reason is that the insert molding requires to fix the core in the molding space while keeping it floating therein. Mere fixing of an end of the core corresponding to a hand of the doll or a foot thereof on an edge of a molding space fails to permit the above-described fixing of the core to be satisfactorily carried out. Also, it is required that the core be embedded in a trunk while being kept floating therein. An injection pressure of a molding material occurring during injection of the material into the molding space is highly increased, therefore, a failure in firm fixing of the core in the molding space causes the core to be forcibly moved by the pressure during the injection, so that the core is deviated from a center of the molding space, to thereby be readily abutted against an inner surface of the molding space. Thus, the conventional elastic doll has problems that the core is externally exposed from a surface of the elastic doll molded, the core is deviated from a center of the elastic doll, to thereby cause unnatural bending, and yields of the elastic doll are reduced.

The present invention has been made so as to eliminate the above-described problems of the prior art. Accordingly, it is an object of the present invention to provide an elastic doll capable of being bent at sites therein which are to be bent and kept from being bent at sites therein which are not desired to be bent, to thereby be deformed into a natural figure or configuration and capable of being reduced in size, and a method for manufacturing the same.

It is another object of the present invention to provide an elastic doll which is capable of preventing stress from being locally concentrated on a core, to thereby ensure enhanced safety and endurance, and which is capable of exhibiting natural motion like motion of the human body and giving a touch like the human skin, and a method for manufacturing the same.

It is a further object of the present invention to provide an elastic doll which is capable of permitting a core (skeleton member) embedded therein to be held at a central position in various parts of the doll, and a method for manufacturing the same.

DISCLOSURE OF INVENTION

In accordance with one aspect of the present invention, an elastic doll is provided. The elastic doll includes a trunk, arms and legs in which a skeleton member is embedded, wherein the skeleton member includes flexible first cores and second cores made of rigid synthetic resin, the first cores and second cores are connected to each other, and the skeleton member is covered with a skin/flesh member made of soft synthetic resin.

In a preferred embodiment of the present invention, the first cores are made of metal, wherein the skeleton member is constituted by the first cores which are arranged at sites in the doll corresponding to joints and the second cores which are arranged at sites in the doll corresponding to distal ends thereof and positions between joints adjacent to each other. The term "joints" in "sites corresponding to joints" does not means "all joints". Thus, in the present invention, the first cores may be arranged at a part of the joints.

In a preferred embodiment of the present invention, the first cores are covered with synthetic resin.

In a preferred embodiment of the present invention, the synthetic resin for covering the first cores and the soft synthetic resin for the skin/flesh member are each a thermoplastic elastomer.

In a preferred embodiment of the present invention, the elastic doll further includes a neck having a part of the skeleton member embedded therein. The first cores are each constituted of a wire. The first cores arranged in the neck, the trunk and the arms and legs are different in diameter from each other.

In a preferred embodiment of the present invention, the skeleton member is integrally formed or formed by integrally coupling skeleton components previously formed separately from each other to each other.

In a preferred embodiment of the present invention, the first cores in the arms and legs each have portions arranged in parallel to each other.

In a preferred embodiment of the present invention, the first cores are each bent at ends thereof.

In a preferred embodiment of the present invention, the first cores are each constituted by an elongated plate-like member made of metal or formed to have a coil-like shape.

In a preferred embodiment of the present invention, the second cores are each formed with a fixing shaft arranged so as to extend therefrom to a surface of the doll. The fixing shaft is made of a material which is compatible with the soft synthetic resin for the skin/flesh member.

In a preferred embodiment of the present invention, the skeleton member includes a foot skeleton section incorporated in each of the legs. The foot skeleton section is externally exposed at a portion thereof corresponding to a sole of a foot of each of the legs from the sole.

In a preferred embodiment of the present invention, the first cores are each made of metal. The skeleton member is constituted by the first cores which are arranged at sites in the doll corresponding to joints and the second cores which are arranged at sites in the doll corresponding to distal ends thereof and positions between joints adjacent to each other. The trunk includes three of such first cores arranged therein so as to be vertically extended, wherein an outer two of the three first cores are inwardly curved with respect to each other.

In a preferred embodiment of the present invention, the second cores are formed at a place thereon facing the joint with small projections.

In accordance with another aspect of the present invention, a method for manufacturing an elastic doll is provided. The method includes the steps of: insert molding second cores on each of flexible first cores so as to be spaced from each other using a skeleton forming material, to thereby form a skeleton member including the first and second cores connected to each other; and insert molding a skin/flesh member on the skeleton member using a skin/flesh forming material.

In a preferred embodiment of the present invention, the skeleton forming material and skin/flesh forming material are compatible with each other, so that the second cores and skin/flesh forming material are welded together during molding.

In a preferred embodiment of the present invention, the skeleton forming material is polyolefin resin and the skin/flesh forming material is an elastomer.

In a preferred embodiment of the present invention, the elastic doll includes a trunk, arms and legs in which a skeleton member is embedded. The skeleton forming material is rigid synthetic resin and the skin/flesh forming member is soft synthetic resin. The step of insert molding the second cores includes forming fixing shafts which extend from the second cores to a surface of the doll. The step of insert molding the skin/flesh member includes arranging the skeleton member in a mold for molding the skin/flesh member, fixing the fixing shafts on mating surfaces of the mold to stabilize the skeleton member and injecting the soft synthetic resin into the mold. The method further includes the steps of removing portions of the fixing shafts projected from the surface of the doll after molding and treating marks left on the surface of the doll due to removal of the projected portions of the fixing shafts.

In a preferred embodiment of the present invention, the step of treating the marks is carried out by melting the surface of the doll.

In a preferred embodiment of the present invention, the skeleton member includes a foot skeleton section incorporated in each of the legs. The step of insert molding the skin/flesh member includes directly abutting a rear surface of a distal end of each of the second cores corresponding to the foot skeleton section against an inner surface of molding spaces in the mold, to thereby securely hold the second cores therein.

In a preferred embodiment of the present invention, the first cores are each made of metal. The skeleton member is constituted by the first cores which are arranged at sites in the doll corresponding to joints and the second cores which are arranged at sites in the doll corresponding to distal ends thereof and positions between joints adjacent to each other. The trunk includes three of the first cores arranged therein so as to be vertically extended, wherein an outer two of the three first cores are inwardly curved with respect to each other.

In a preferred embodiment of the present invention, the second cores are formed at a place thereon facing a joint with small projections.

In a preferred embodiment of the present invention, the fixing shafts are each arranged at a site in the doll at which an injection pressure of the soft synthetic resin is unstable when the soft synthetic resin is injected into the mold.

In accordance with a further aspect of the present invention,sa method for molding an elastic doll which includes a trunk, arms and legs in which a skeleton member is embedded is provided. The method includes the steps of providing cores made of rigid synthetic resin to constitute the skeleton member, wherein fixing shafts are formed to extend from the cores to a surface of the doll, arranging the skeleton member in a mold and fixing the fixing shafts on mating surfaces of the mold to stabilize the skeleton member, injecting soft synthetic resin into the mold, and removing portions of the fixing shafts projected from the surface of the doll after molding and treating marks left on the surface of the doll due to removal of the projected portions of the fixing shafts.

It is preferable that the treating of the marks be carried out by melting the surface of the doll.

It is preferable that the skeleton member include a foot skeleton section incorporated in each of the legs, and a rear surface of a distal end of each of the cores corresponding to the foot skeleton section be directly abutted against an inner surface of molding spaces in the mold, to thereby be securely held therein.

It is preferable that the skeleton member be constituted by first cores made of metal and arranged at sites in the doll corresponding to joints and second cores made of rigid synthetic resin and arranged at sites in the doll corresponding to distal ends thereof and positions between joints adjacent to each other, and the trunk include three of such first cores arranged therein so as to be vertically extended, wherein an outer two of the three first cores are inwardly curved with respect to each other.

In addition, it is preferable that the cores of the skeleton member be formed at a place thereon facing a joint with small projections.

It is preferable that the fixing shafts be each arranged at a site in the doll at which an injection pressure of the soft synthetic resin is unstable when the soft synthetic resin is injected into the mold.

BEST MODES FOR CARRYING OUT INVENTION

Now, the present invention will be described in connection with embodiments thereof with reference to the accompanying drawings.

Figure 1A:
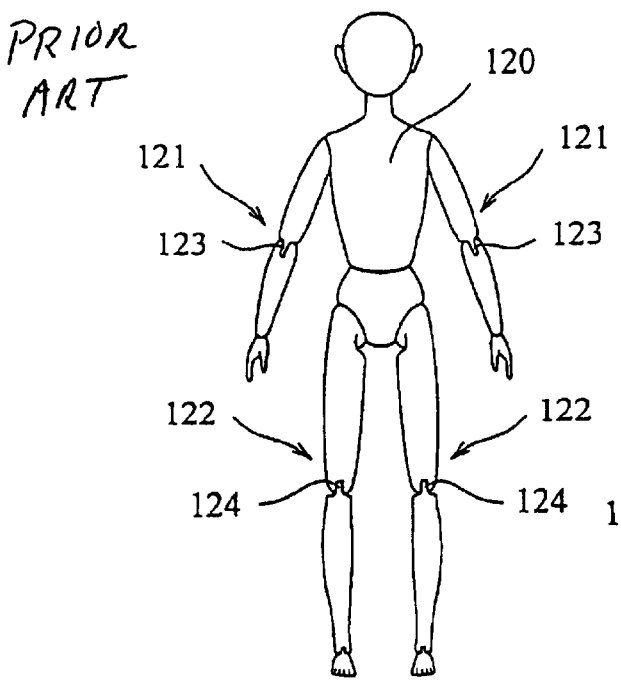
FIGS. 1A and 1B each are a schematic view showing a conventional doll; prior art
Figure 1B:
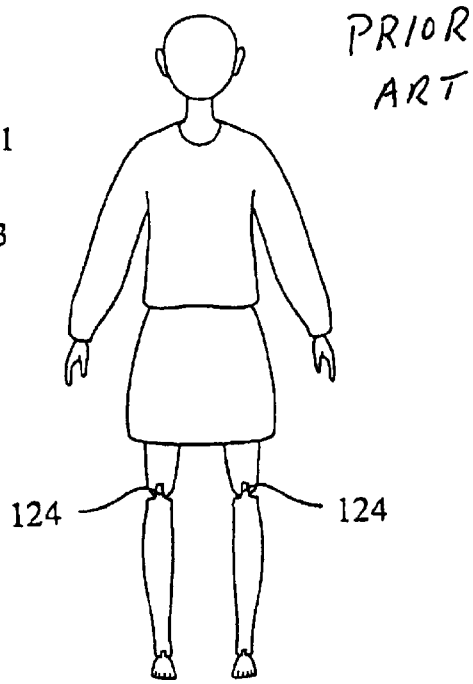
Figure 2:
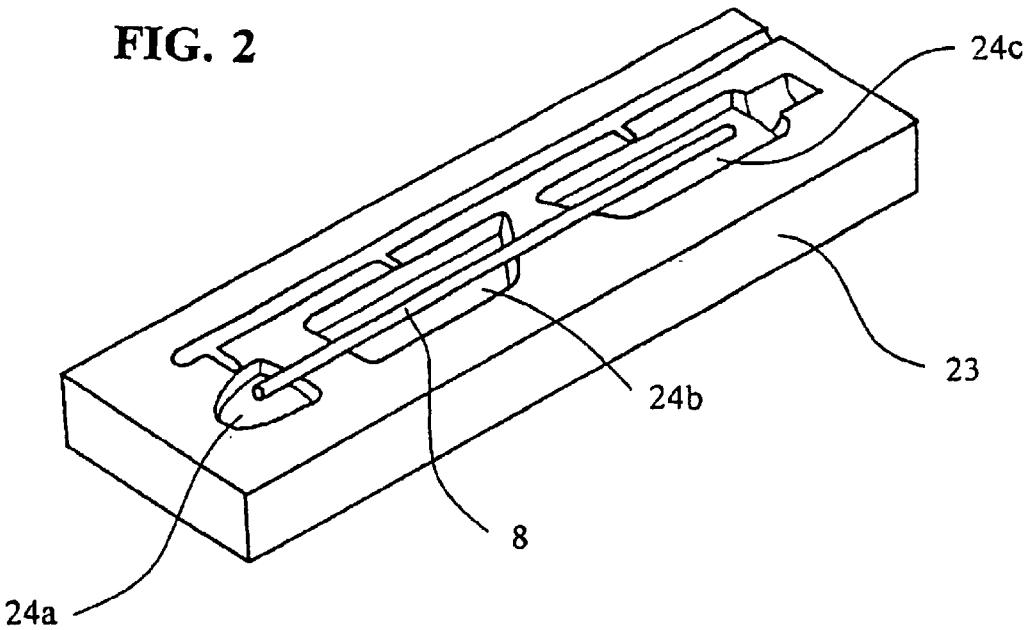
FIG. 2 is a perspective view showing a first mold used for manufacturing an elastic doll according to one embodiment of the present invention by way of example.

Referring first to FIGS. 2 to 6, an embodiment of an elastic doll according to the present invention is illustrated. In FIG. 2, reference numeral 23 designates a first mold used for molding an arm according to a method for manufacturing an elastic doll according to the present invention. The first mold 23 is formed therein with a first space 24*a* for molding a first section of a second core in imitation of hand bones therein, a second space 24*b* for molding a second section of the second core in imitation of a radius therein and a third spacer 24*c* for molding a third section of the second core in imitation of a humerus therein. The first mold 23 functions to carry out insert molding of a skeleton member 7 using a flexible wire or the like as a first core 8 and a skeleton forming material consisting of polyolefin resin such as polypropylene or the like.

Figure 3:
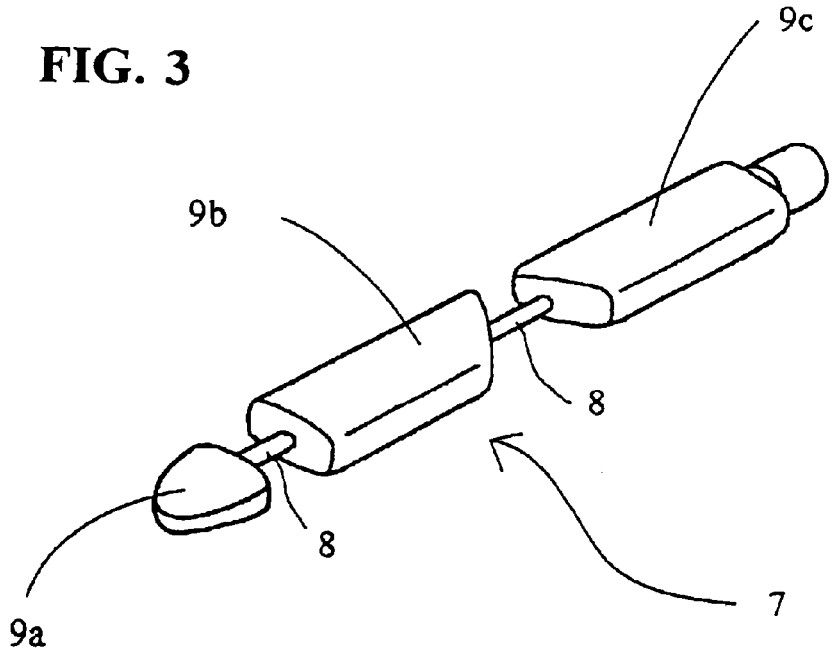
FIG. 3 is a perspective view showing a skeleton member molded by the first mold.

The skeleton member 7 molded by means of the first mold 23 using the first core 8 as an insert, as shown in FIG. 3, has a first section 9*a* of a second core, a second section 9*b* thereof and a third section 9*c* thereof formed on the first core 8 such as a wire or the like so as to be spaced from each other at predetermined intervals, resulting in the first core 8 being formed with exposed sections which correspond to joints of a wrist, an elbow and the like, respectively. Such construction permits the first core 8 to be bent at only the exposed sections while preventing it from being bent at the sections 9*a* to 9*c* of the second core.

Figure 4:
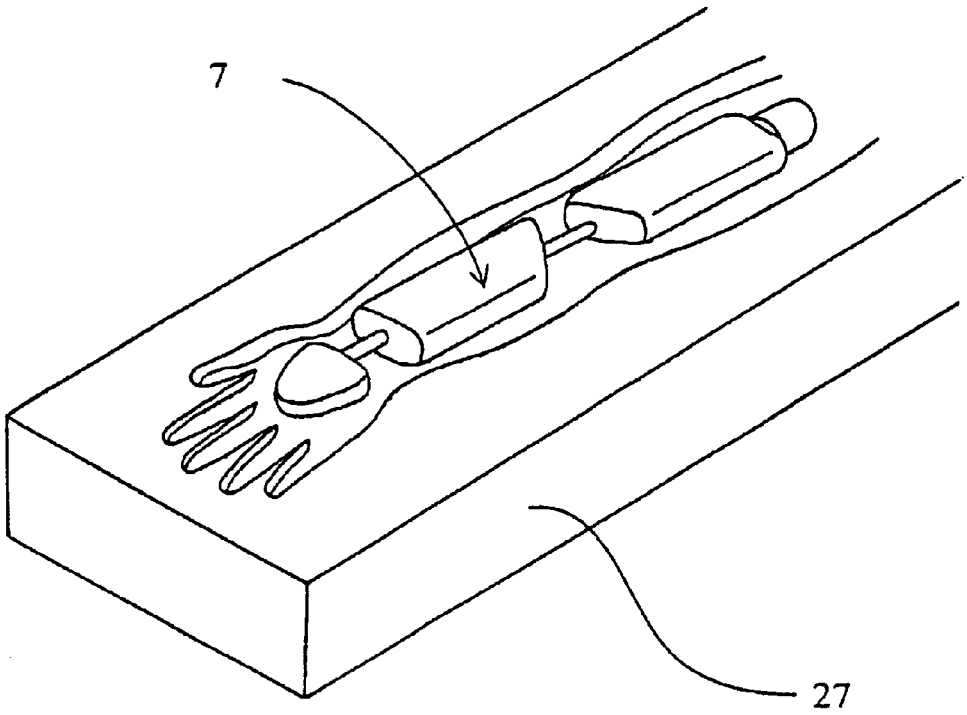
FIG. 4 is a perspective view of the skeleton member set in a second mold.
Figure 5:
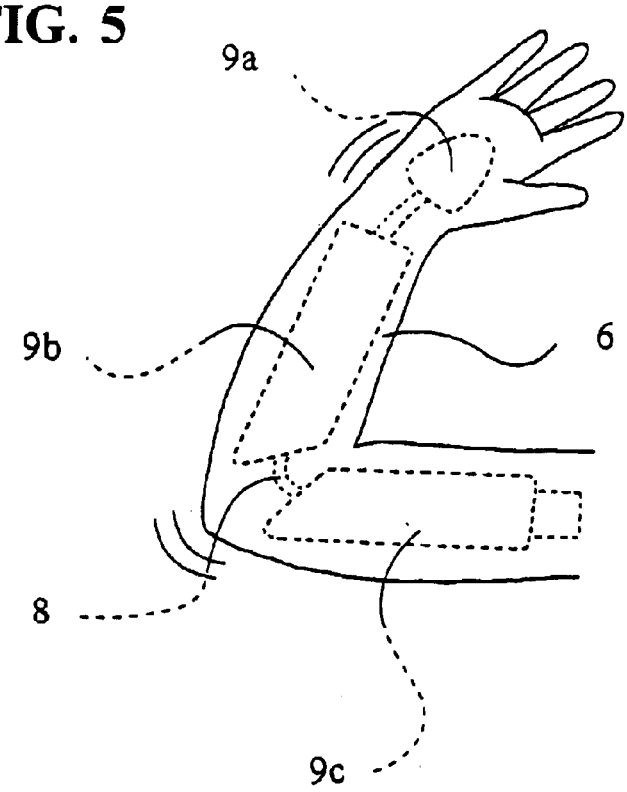
FIG. 5 is a perspective view showing deformation of a molded arm for an elastic doll.

The skeleton member 7, as shown in FIG. 4, is set as an insert in a second mold 27 and then a skin/flesh forming material consisting of an elastomer is subjected to insert molding to form a skin/flesh member 6 around the skeleton member 7. In this instance, the molding material for the skin/flesh member 6 and that for the skeleton member 7 are constituted by materials which are compatible with each other, respectively, to thereby permit the skin/flesh member 6 and the first to third sections 9*a* to 9*c* of the second core to be satisfactorily welded together. This permits the skeleton member 7 and skin/flesh member 6 to be deformed in association with each other without being separated from each other when an arm molded is bent as shown in FIG. 5. Also, the first to third sections 9*a* to 9*c* of the second core are made of a rigid material, so that bending of the arm is carried out at any exposed section of the first core 8 without bending of the second core, resulting in unnatural deformation of the arm such as bending thereof at any intermediate portion thereof, curving of the whole arm or the like being eliminated.

Also, the whole elastic doll may be formed by the above-described double insert molding.

Figure 6:
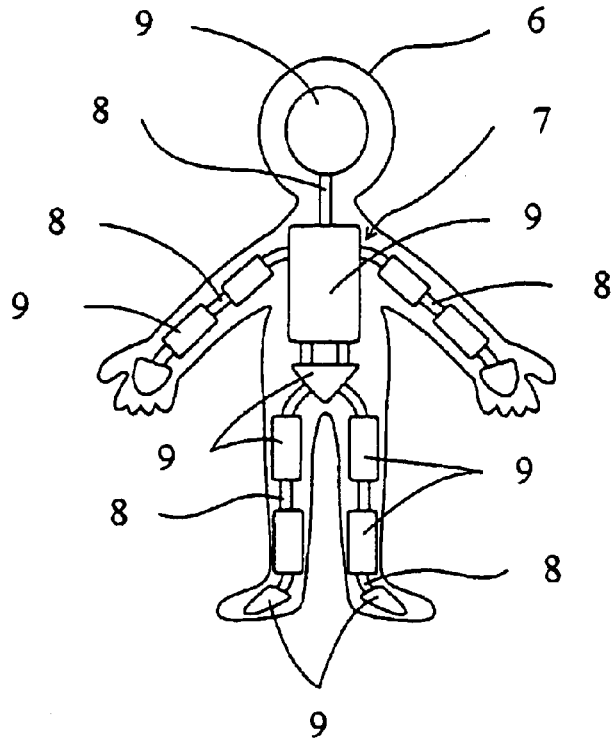
FIG. 6 is a schematic front elevation view showing a doll molded according to the present invention.

In this instance, as shown in FIG. 6, a whole skeleton is made of the first cores 8 such as a wire or the like and insert molding of the skeleton member 7 constituted by a plurality of second cores 9 is carried out using the whole skeleton as an insert. Then, insert molding of the skin/flesh member 6 is carried out using the skeleton member 7 thus molded as an insert.

Such molding permits the elastic doll to be formed to have a small size. Also, the elastic doll molded ensures bending of sections of the doll which are desired to be bent and prevents bending of sections thereof which are not desired to be bent, leading to natural deformation of the doll. Thus, the elastic doll of the illustrated embodiment carries out satisfactory deformation as seen in a large-sized doll while being reduced in size, to thereby permit a user to enjoy doll play.

In the illustrated embodiment, the second cores are arranged on the flexible first cores so that the first cores are not covered at the portions thereof corresponding to the joints of the doll with the second cores. Such construction permits the arms of the doll and the like to be positively bent at the joints, to thereby prevent bending of the doll at unnatural portions thereof, so that the doll exhibits enhanced reality while being simplified in structure.

Also, in the illustrated embodiment, a material for the second cores and that for the skin/flesh member are compatible with each other, so that insert molding of the skin/flesh member using the skeleton member as an insert may permit the second cores and skin/flesh member to be welded together on an interface therebetween, to thereby prevent the skeleton member from being shifted in the skin/flesh member. Thus, the doll may be deformed in a natural manner when the arms are bent, resulting in enjoyable doll play being provided.

Further, when the skeleton member is made of polyolefin resin and the skin/flesh member is made of an elastomer, the doll which may give a good feeling to the touch and carry out deformation in a natural manner can be formed.

Figure 7:
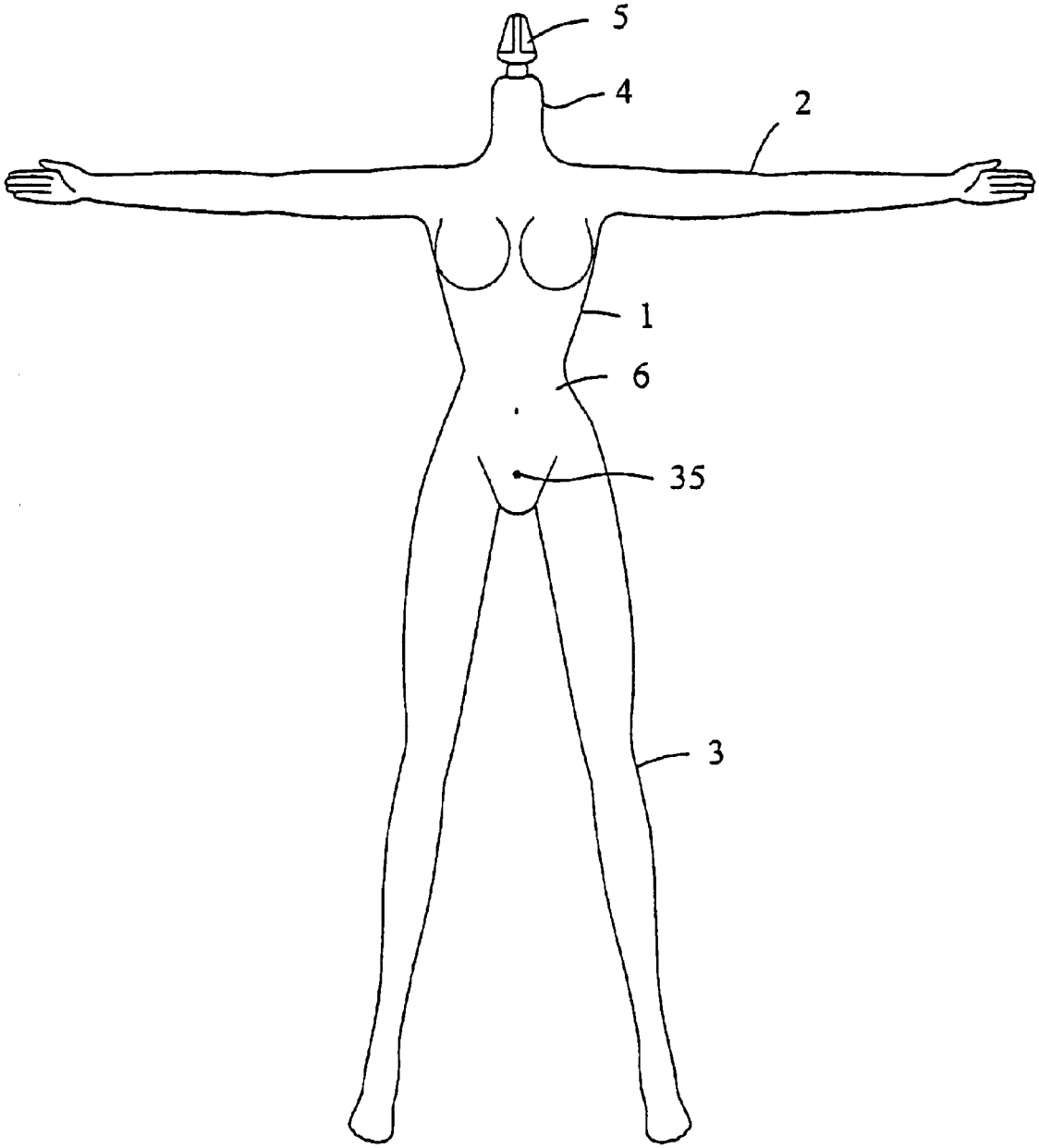
FIG. 7 is a front elevation view showing an elastic doll according to another embodiment of the present invention.
Figure 8:
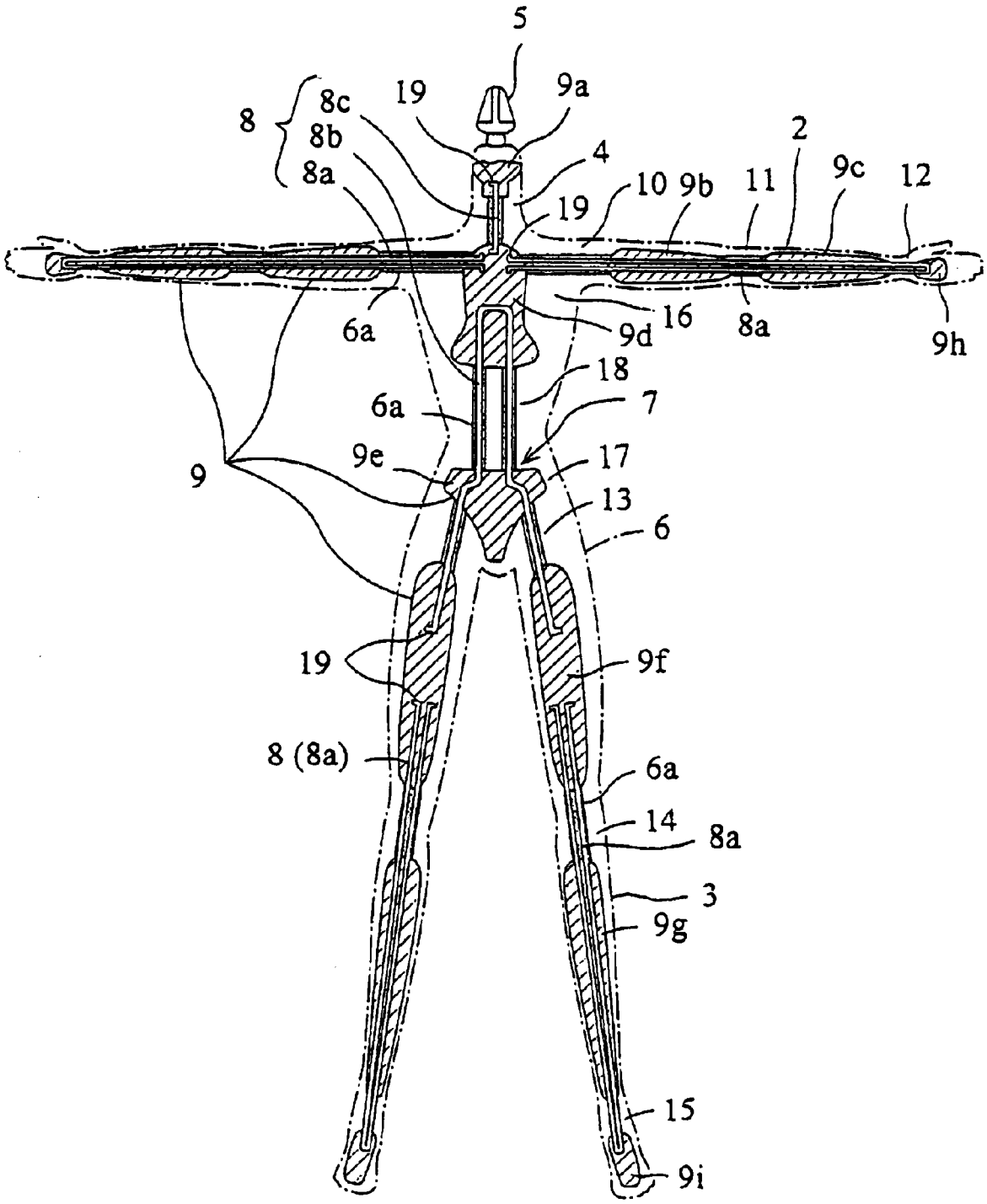
FIG. 8 is a front elevation view in section of the elastic doll shown in FIG. 7 from which a skin/flesh member is removed and which is vertically sectioned.
Figure 9:
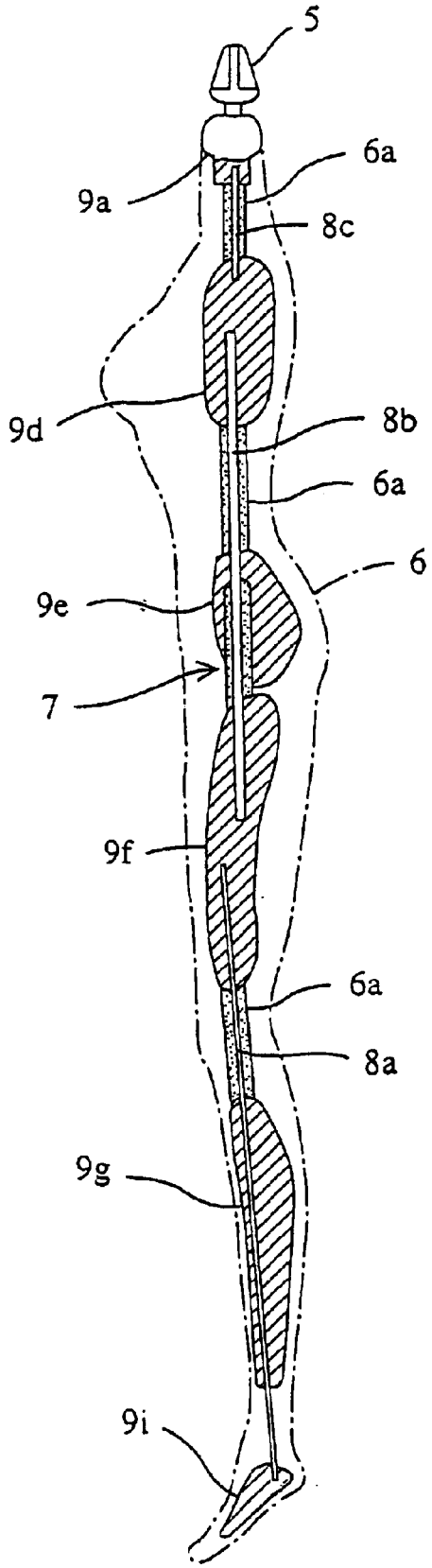
FIG. 9 is a side elevation view partly in section of the elastic doll shown in FIG. 7 from which the skin/flesh member is removed.

Referring now to FIGS. 7 to 17, another embodiment of an elastic doll according to the present invention is illustrated. FIG. 7 is a front elevation view showing an elastic doll of the illustrated embodiment and FIGS. 8 and 9 are a front elevation view and a side elevation view each showing an internal structure of the elastic doll, respectively. The elastic doll of the illustrated embodiment includes a trunk 1, arms 2 and legs 3. Also, it includes a neck 4 provided on an upper portion thereof with a neck pin 5, on which a head (not shown) is detachably supported.

The elastic doll has a surface which is constituted by a skin/flesh member 6 made of a soft synthetic resin material. The skin/flesh member 6 is preferably made of a thermoplastic elastomer such as, for example, a styrene elastomer manufactured under a designation "Leostomer" (trademark) by RIKEN VINYL INDUSTRY CO., LTD. The thermoplastic elastomer has a hardness of preferably about 10 to 20. Most preferably, it has a hardness of 15. The thermoplastic elastomer below 10 in hardness is excessive soft, whereas the elastomer above 20 in hardness fails to exhibit flexibility or softness like the human skin.

The elastic doll, as shown in FIGS. 8 and 9, has a skeleton member 7 embedded therein, which is covered with the above-described skin/flesh member 6.

The skeleton member 7 is constituted by first cores 8 made of metal and second cores 9 made of rigid synthetic resin which are integrally connected to each other. The first cores 8 are arranged at sites in the doll corresponding to joints and the second cores 9 are arranged at sites in the doll corresponding to distal ends thereof and positions between joints adjacent to each other.

More particularly, the first cores 8 are each made of an iron wire, a stainless steel wire or the like and arranged at shoulders 10 of the doll, elbows 11 thereof, wrists 12 thereof, a crotch 13 thereof, knees 14 thereof and ankles 15 thereof as well as the above-described neck 4. The arms 2 and legs 3 each have a first core 8*a* arranged therein. The first core 8*a* includes parallel portions formed by bending the first core 8*a* into a U-shape at a tip of a hand or foot. Also, the trunk 1 has a first core 8*b* arranged at a center therein. More specifically, the first core 8*b* is arranged at a site in the trunk 1 positioned between a breast 16 and a waist 17 (or at a stomach 18) and corresponding to a backbone. This is due to the reason that the portion between the breast 16 and waist 17 may be considered to be a joint in a broad sense in view of the fact that it is bent.

The first cores 8 are formed to have diameters different from each other depending on sites in the doll at which they are arranged. More particularly, the first core 8*b* arranged in the trunk 1 is formed to have the largest diameter. Then, a first core 8*c* arranged in the neck 4 is formed to have an intermediate diameter and the first core 8*a* in each of the arms 2 and legs 3 has the smallest diameter. However, the illustrated embodiment is not limited to such a difference in diameter. It may be suitably determined depending on frequency of bending of the first core at each of the sites. Also, it is not necessarily required that the first cores 8 be arranged at all joints. They may be arranged at a part of the joints. The first cores 8 are each bent at ends 19 thereof.

The first cores 8 are each covered with a synthetic resin material 6*a*. The synthetic resin 6*a* functions to prevent the first core 8 from being bent at a sharp or acute angle. It is preferably the same material (thermoplastic elastomer) as the skin/flesh member 6. When the thermoplastic elastomer is selected for this purpose, it most preferably has a hardness of about 25 to 35. In particular, the hardness of 30 is optimum. The first core 8 is covered with the synthetic resin 6*a* in order to permit bending force to be uniformly applied to the first core 8 while preventing the first core 8 from being bent at an acute angle at any particular site and permit the first core 8*a* once 30 bent to be kept bent. The synthetic resin having a hardness below 25 fails to prevent the first core from being bent at an acute angle, whereas the hardness above 35 substantially fails to keep the first core bent because the resin excessively exerts force of restoring it to its original configuration.

The second cores 9 are each arranged between the joints adjacent to each other. More particularly, second cores 9*a*, 9*b*, 9*c*, 9*d*, 9*e*, 9*f* and 9*g* are arranged at the neck 4, between each of the shoulders 10 and each of the elbows 11, between each elbow 11 and each wrist 12, between the neck 4 or each of the shoulders 10 and the stomach 18, between the stomach 18 and crotch 13, between the crotch 13 and each knee 14, and between each knee 14 and each foot 15. Also, the second cores 9 are arranged at the distal end of each of the arms 2 and that of each of the legs 3. More specifically, a second core 9*h* is arranged at the distal end of each arm 2 and a second core 9*i* is arranged at the distal end of each leg 3. Thus, the second cores 9 are arranged at sites in the doll corresponding to bones, thereby not to be bent. Therefore, the second cores 9 may each be made of rigid synthetic resin. For this purpose, a rigid synthetic resin material such as polypropylene or the like which is compatible with a thermoplastic elastomer is preferably used. The reason is that it can be satisfactorily coupled to the skin/flesh member 6, thus, it does not give any strange or abnormal feeling when it is bent and it effectively prevents torsion or dislocation between the second cores 9 and the skin/flesh member 6.

As described above, of the first cores 8, the first core 8*b* arranged in the trunk 1 has the largest diameter, to thereby be hard to bend at a sharp or acute angle, resulting in it being curvedly bent while describing a large arc as in bending of a backbone of the human body. Also, the first core 8*a* arranged in each of the arms 2 and legs 3 is formed to have a diameter smaller than the first core 8*b* and has the above-described portions arranged in parallel with each other, to thereby be easy to bend forwardly and rearwardly or in a direction which is perpendicular to a plane in which the parallel portions are positioned and hard to bend in a vertical direction or in the plane. This permits the doll to carry out motion or movement highly similar to that of the human body. Also, the ends 19 of each of the first cores 8 are bent, to thereby minimize a possibility that the ends outwardly project through the skin/flesh member 6, resulting in them substantially preventing damage to children, so that the doll may exhibit enhanced safety. Also, bending of the ends ensures safety of the doll even when they break through the skin/flesh member 6.

The first cores 8 are not limited to the above-described thickness and number. For example, one such first core may be embedded in each of a combination of the right arm, trunk, right leg and a combination of the left arm, trunk and left leg. Also, the first cores 8 may each have the skin/flesh member 6 directly arranged therearound so as to cover it.

Figure 10:
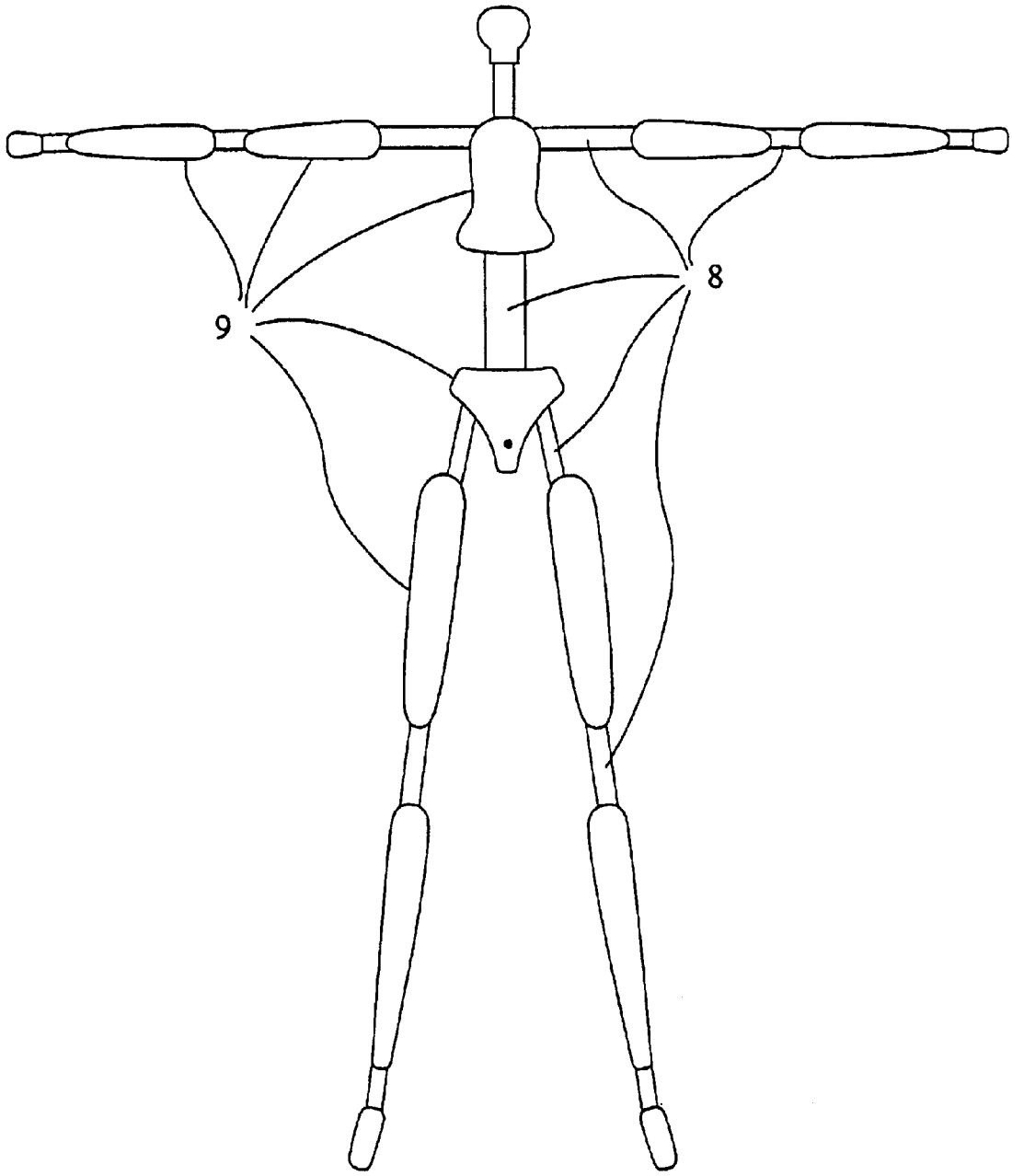
FIG. 10 is a front elevation view showing a modification of a skeleton member.

Further, the first cores 8 are not limited to a straight configuration. Each of them, as shown in FIG. 10, is constituted by an elongated plate-like member made of metal. Alternatively, each of them may be constituted by a coiled member made of metal so that each of joints may be recessed.

Figure 11:
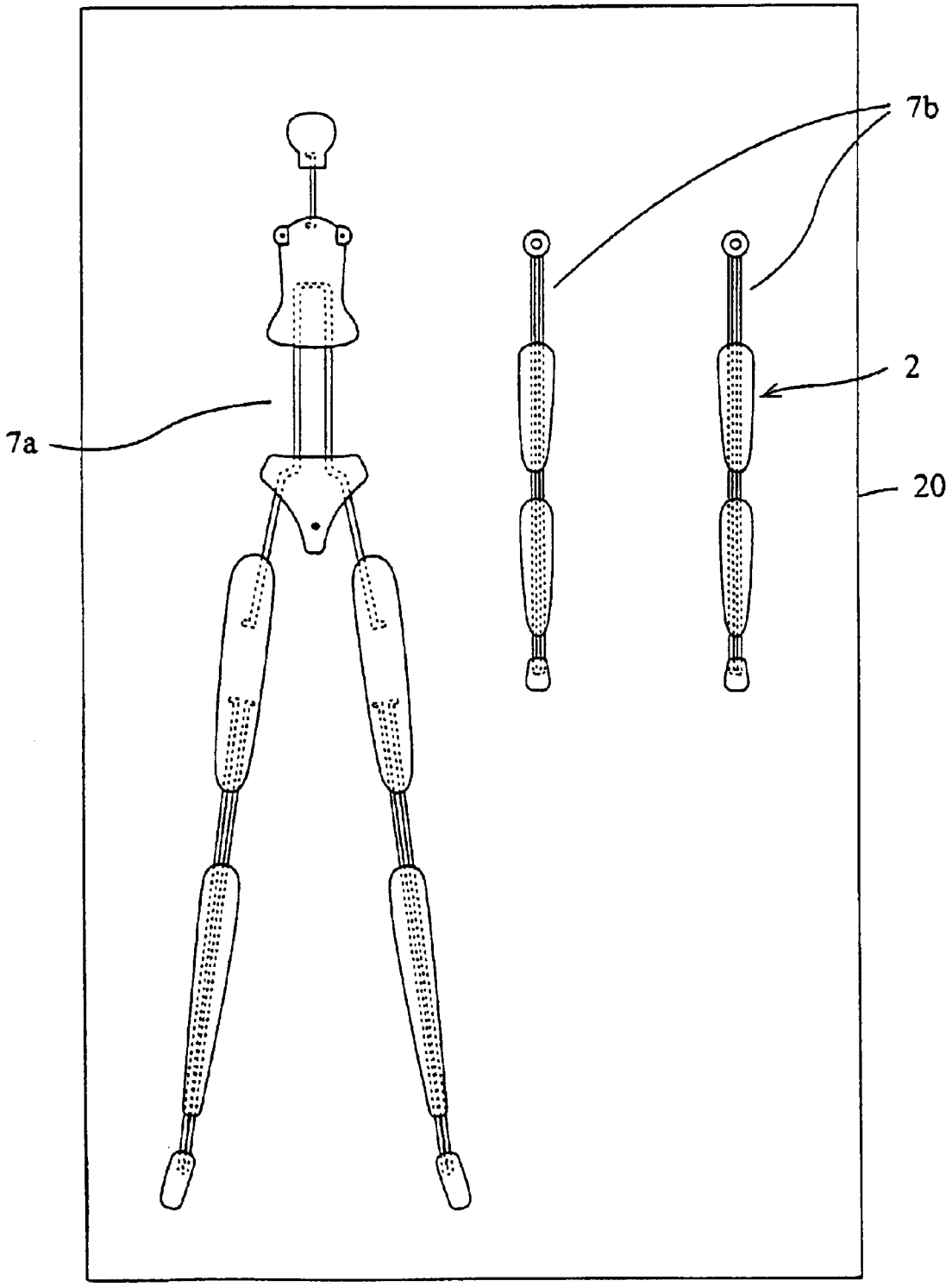
FIG. 11 is a front elevation view of the skeleton member which is separated into three skeleton components.
Figure 12:
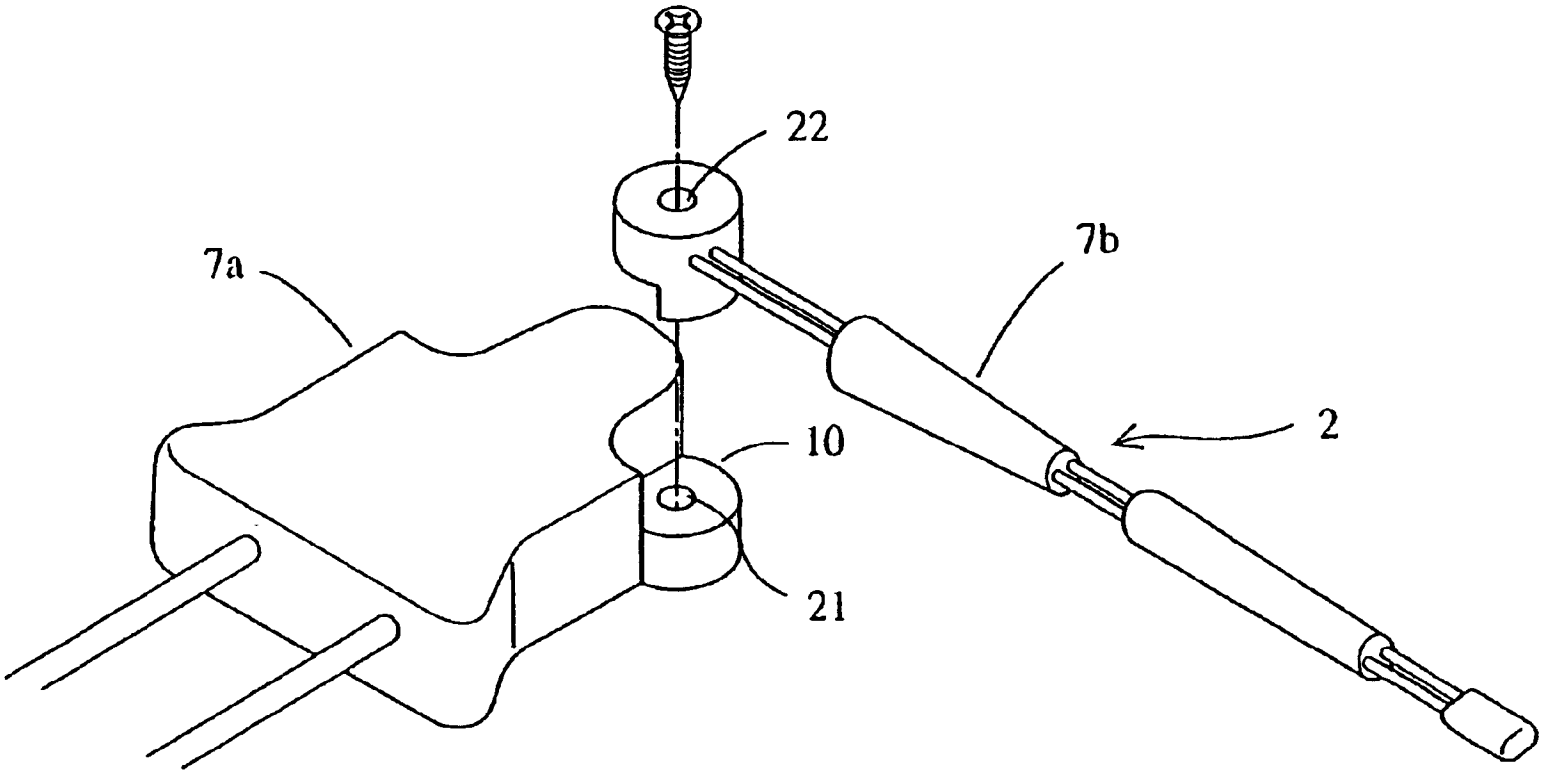
FIG. 12 is a schematic view showing a manner of connection of the skeleton components shown in FIG. 11.

In addition, the skeleton member 7 may be formed by integrally coupling skeleton components previously formed separately from each other to each other. For example, when skeleton components 7*b* for both arms 2 and a skeleton component 7*a* for the trunk 1 are molded separately from each other as shown in FIG. 11, a mold 20 may be reduced in size, resulting in a manufacturing cost being reduced. Also, such construction permits the mold 20 to be horizontally set. Thus, the skeleton member 7 may be stably held in the mold. In this instance, as shown in FIG. 12, the shoulders 10 may each be formed with a screwing section 21 and correspondingly the arms 2 may each be formed at a proximal portion thereof with a screw inserting hole 22. Such construction permits the above-described skeleton components 7*a* and 7*b* to be integrally coupled together by screwing. Therefore, insert molding while keeping both components thus coupled together permits manufacturing of a finished product identical with the above-described one. On the contrary, when both arms 2 and the trunk 1 are integrated with each other, the arms are caused to extend in both lateral directions, so that a whole size of the mold is increased, leading to an increase in manufacturing cost.

Figure 13:
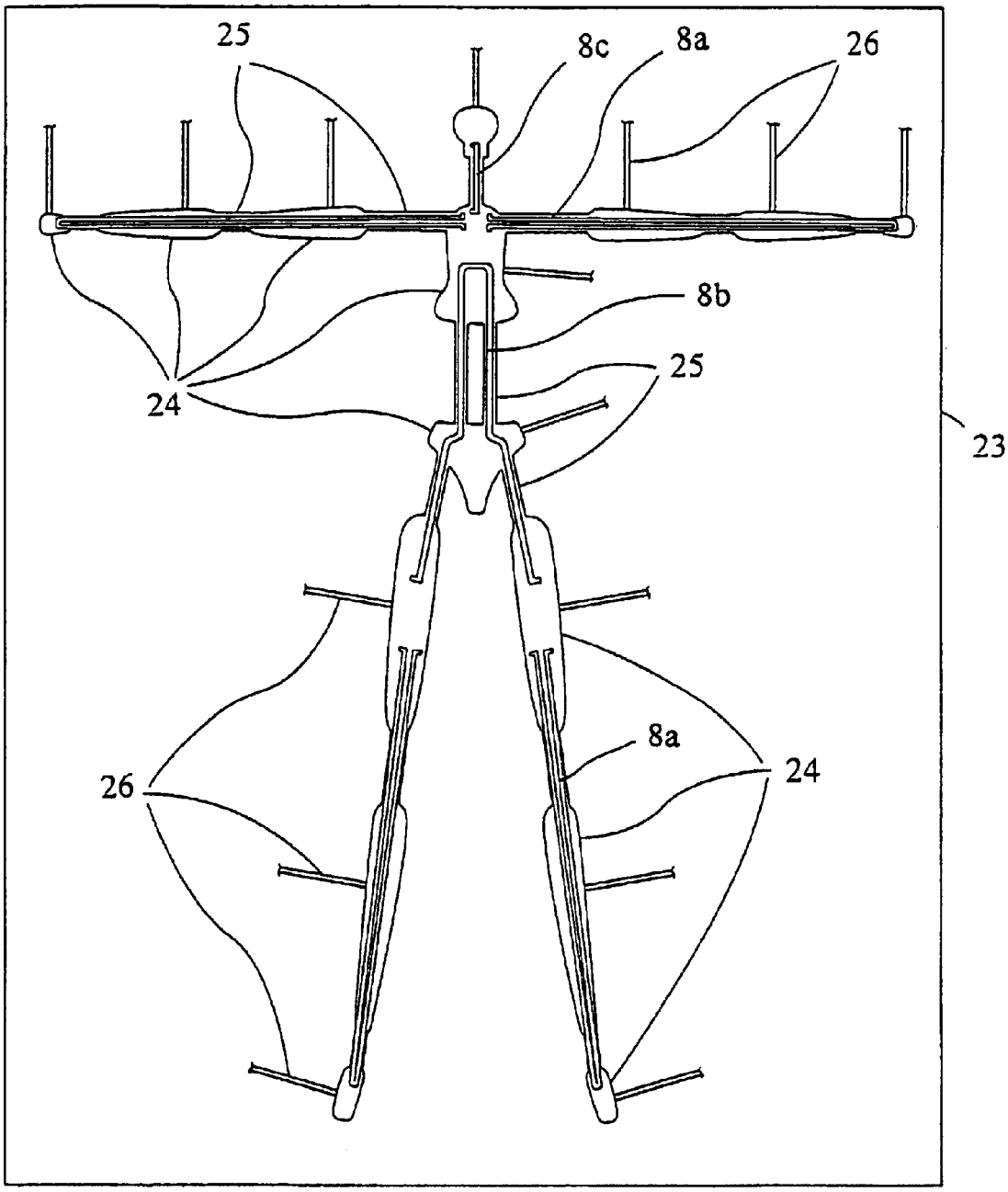
FIG. 13 is a schematic view showing a manner of molding of the skeleton member.
Figure 14:
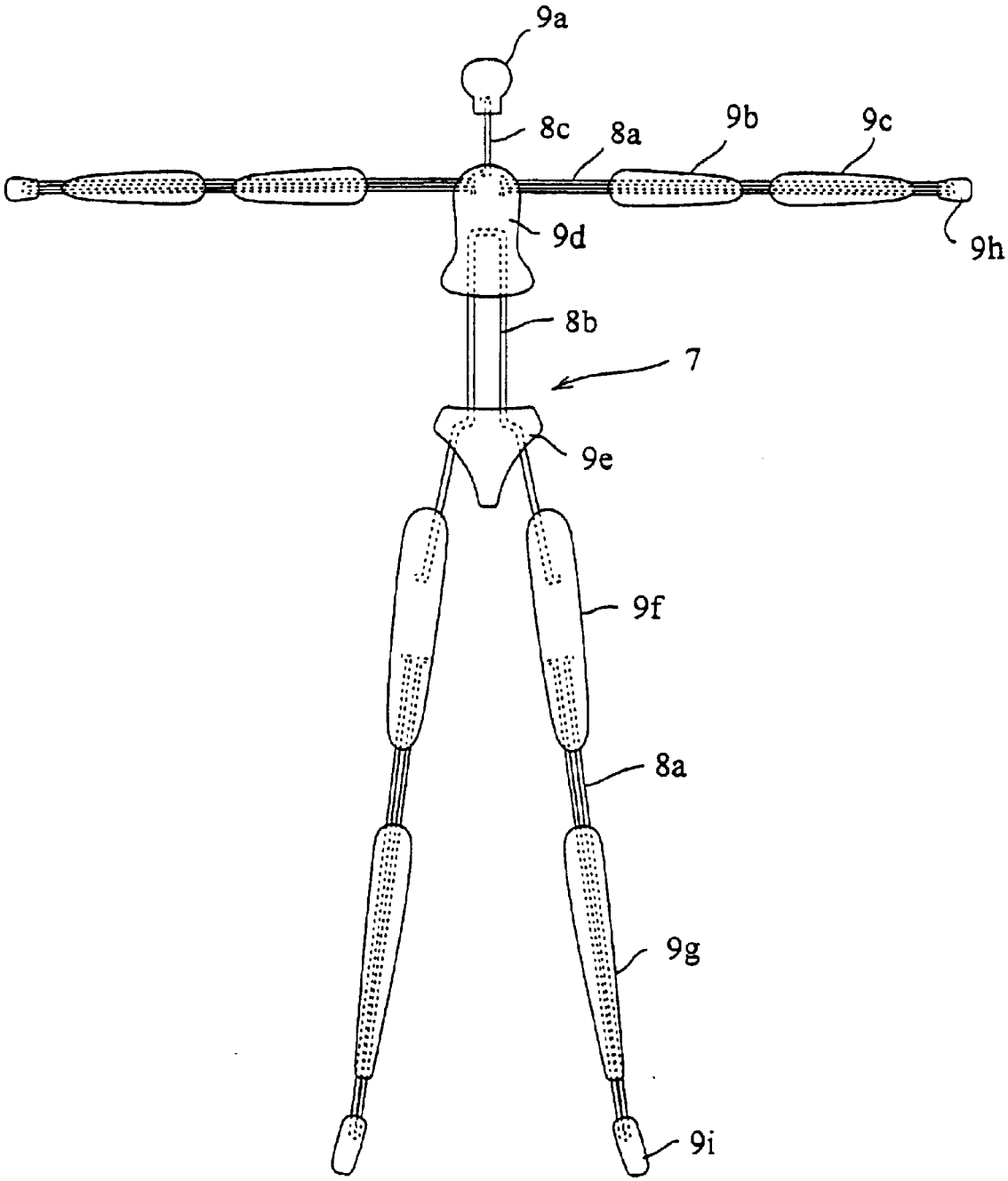
FIG. 14 is a front elevation view of the skeleton member.

Now, manufacturing of the elastic doll thus constructed will be described. First of all, as shown in FIG. 13, the first cores 8*a*, 6*b* and 8*c* are each held at a predetermined position in a mold 23. The mold 23 is formed at sites therein corresponding to the second cores 9 with spaces 24. Also, it is formed with first core fixing sections 25. The first cores 8*a*, 8*b* and 8*c* are partially placed in the fixing sections 25 of the mold 23, to thereby be fixedly interposed between a pair of mold members of the mold 23 when the mold members are joined together to close the mold 23. Fixing of the first cores 8 may be carried out by arranging magnets in the mold to securely hold the first cores 8 on the magnets by magnetic attraction. Reference numeral 26 designates runners for resin. Then mold is tightly closed, a molten resin material (polypropylene or the like) is injected through the runners 26 into the space 24. After cooling, the mold is opened, so that the skeleton member 7 constituted by the first cores 8 (8*a*, 8*b* and 8*c*) and second cores 9 (9*a* to 9*i*) connected to each other is obtained, as shown in FIG. 14.

Figure 15:
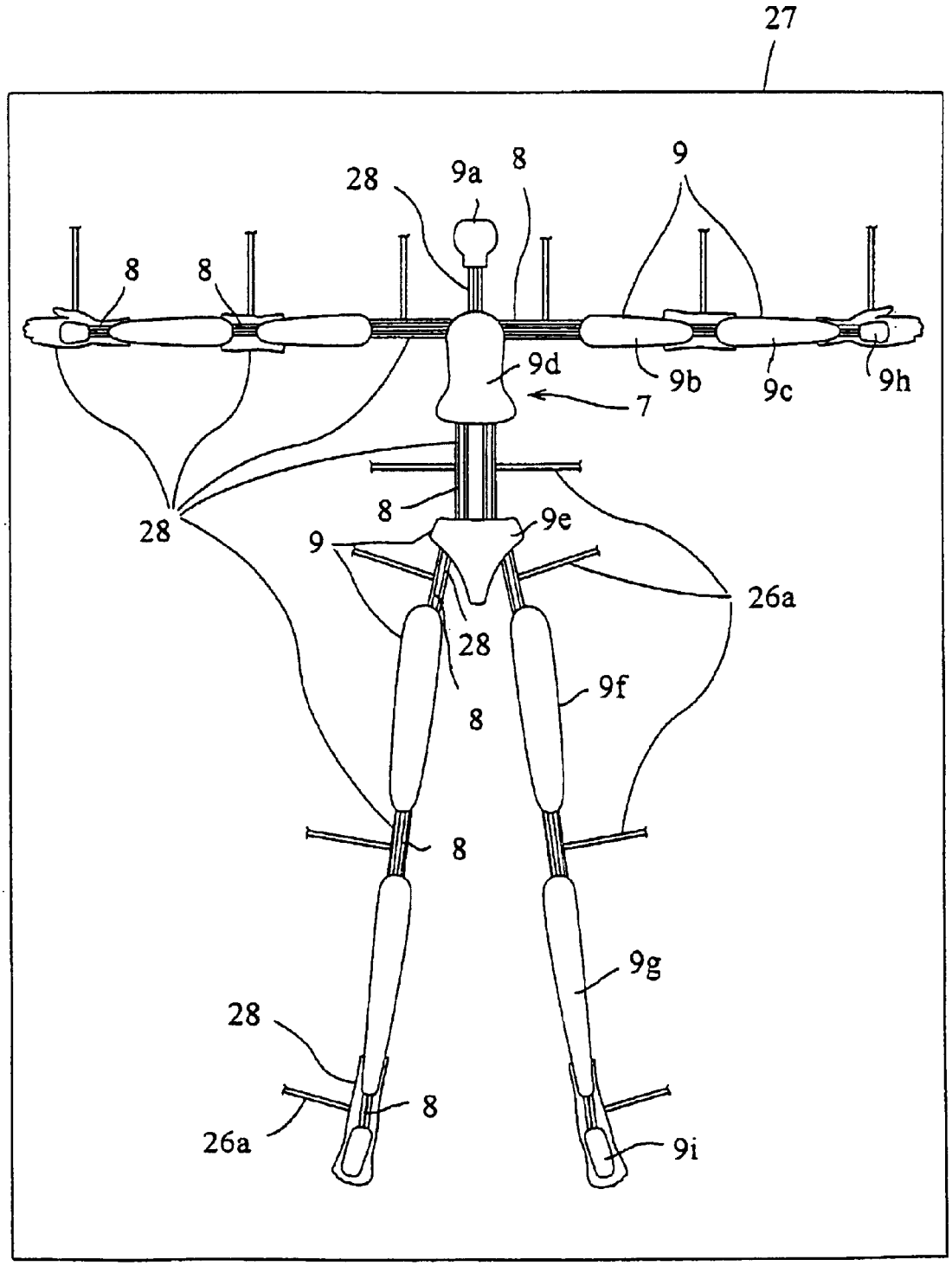
FIG. 15 is a schematic view showing a manner of coating synthetic resin on first cores of the skeleton member to make a semi-finished product.
Figure 16:
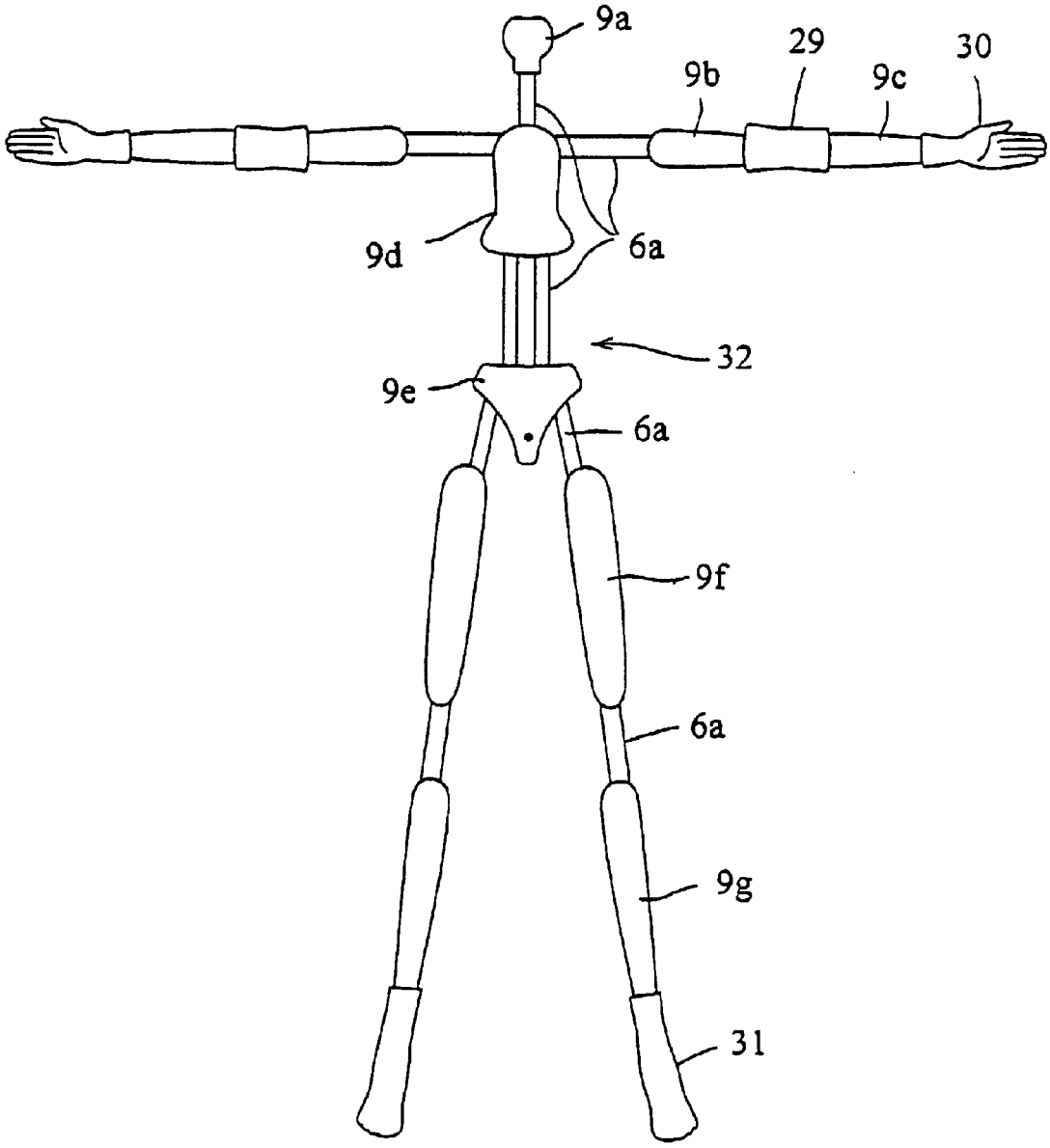
FIG. 16 is a front elevation view of the semi-finished product.

Then, the thus-obtained skeleton member 7 is securely placed in another mold 27, as shown in FIG. 15. The mold 27 is formed at sites therein corresponding to exposed portions of the first cores 8, the arms, the hands and the feet with spaces 28. The spaces 28 each have a runner 26*a* communicating therewith. The second cores 9 are held inside the mold when the mold is closed. After the mold is closed to securely hold the skeleton 7 in the mold, a molten resin material is injected through the runners 26*a* into the spaces 28. At this time, the runners 26*a* corresponding to the first cores 8 are fed with a thermoplastic elastomer 6*a* having a hardness of 30, whereas the runners 26*a* for the arms, hands and feet are fed with a thermoplastic elastomer having a hardness of 15. The mold is opened after cooling thereof, so that a semi-finished product 32 is obtained, wherein the first cores 8 are covered with the thermoplastic elastomer 6*a* of 30 in hardness and elbows 29, hands 30 and feet 31 are made of the thermoplastic elastomer of 15 in hardness, as shown in FIG. 16.

Figure 17:
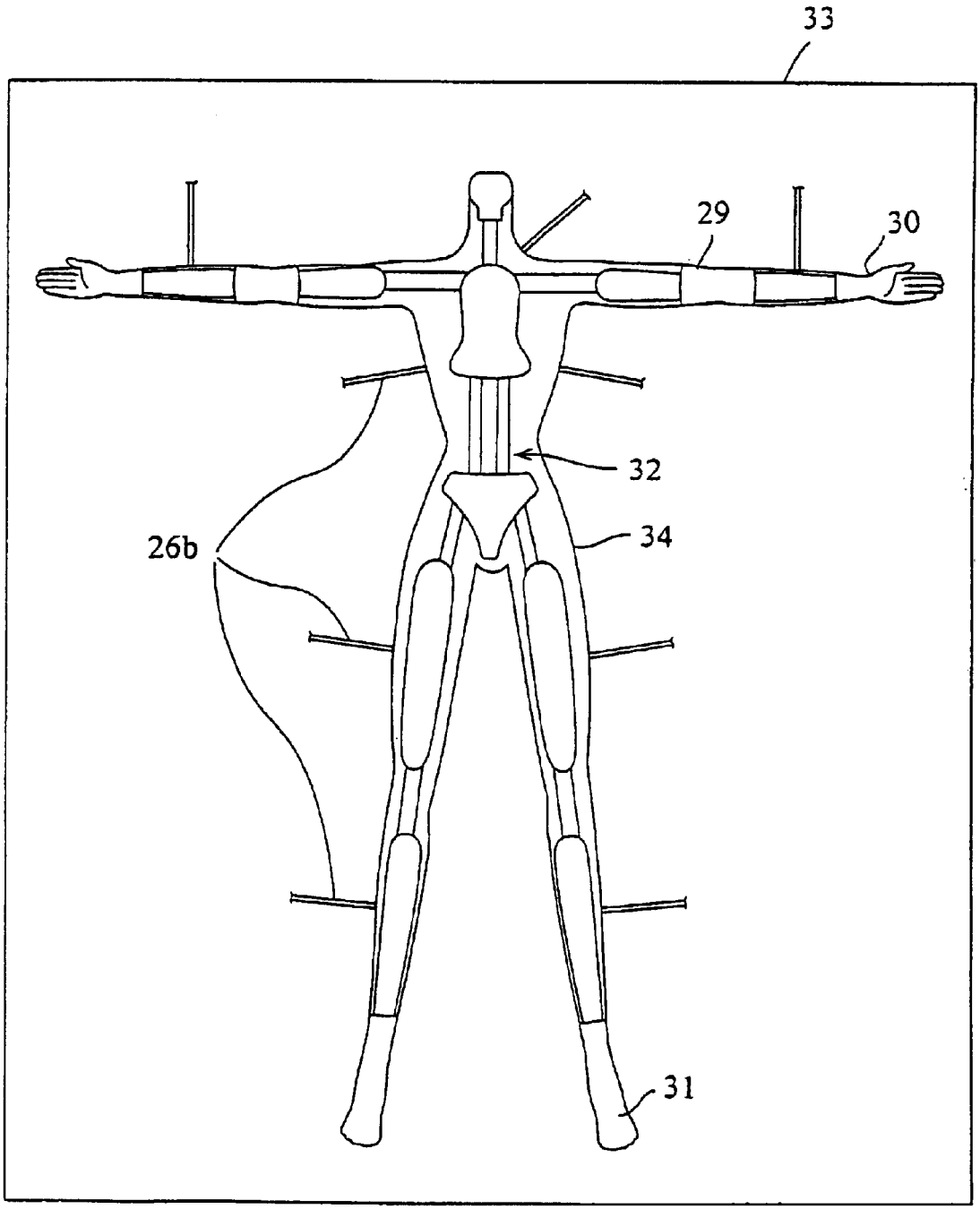
FIG. 17 is a schematic view showing a manner of forming a finished product or elastic doll.

Subsequently, the thus-obtained semi-finished product 32 is securely placed in a further mold 33 as shown in FIG. 17. The mold 33 is formed therein with spaces 34 into which a resin material for the skin/flesh member of the elastic doll is injected, except for the elbows 29, hands 30 and feet 31. Of the mold 33, portions thereof corresponding to the elbows 29, hands 30 and feet 31 are fixed when the mold is closed, resulting in the semi-finished product 32 being securely held in the mold 33 while being floated in the spaces 34. In order to ensure that the semi-finished product 32 is securely held at a central position thereof, it is preferable that one of mold members of the mold 33 be mounted thereon with a fixing pin (not shown), resulting in the semi-finished product 32 being abutted at a lower abdomen thereof against a distal end of the fixing pin. After the mold 33 is closed, a molten material (thermoplastic elastomer of 30 in hardness) is injected through runners 26*b* into the spaces 34. When the mold 33 is opened after cooling thereof, a finished product wherein the skeleton member 7 is covered with the skin/flesh member 6 is obtained, as shown in FIG. 17. The lower abdomen of the elastic doll is formed thereon with a mark 35 of the fixing pin. However, it is normally covered with underwear, to thereby be out of sight, so that the mark may be ignored.

Manufacturing or molding of the elastic doll shown in FIG. 17 is not limited to the above-described manner. For example, the elbows 29, hands 30 and feet 31 may be formed together with other parts in the last step.

In the illustrated embodiment, the first cores are covered with synthetic resin, to thereby prevent the joint sections from being bent at an acute angle, resulting in stress being prevented from being locally concentrated at apart of the first cores when the joint sections are bent. This substantially eliminates accidents such as breakage of the first cores and the like, so that the elastic doll may exhibit increased safety and durability. Also, the second cores are arranged at sites in the elastic dolls corresponding to bones of the human body and made of rigid synthetic resin, to thereby be prevented from being bent, so that the elastic doll may exhibit enhanced reality because unnaturalness that the doll is bent at portions thereof other than the joints is eliminated.

The illustrated embodiment, as described above, may be constructed so that synthetic resin covering the first cores and soft synthetic resin for the skin/flesh member are each constituted by a thermoplastic elastomer. Such construction permits both materials to be compatible with each other, to thereby be readily integrated with each other. Also, such construction permits the doll to give a feeling like the human skin, resulting in the doll exhibiting enhanced reality. Also, the doll may be so constructed that the first cores are constituted by a wire and are varied in diameter depending on the sites in the doll in which they are arranged such as the neck, trunk, arms and legs. This permits a degree of bending of the first cores and an angle thereof to be varied depending on the sites as desired, so that the doll of the illustrated embodiment may carry out bending suitable for each of the sites.

Integral formation of the skeleton member facilitates molding of the elastic doll. Also, formation of the skeleton member by integrally coupling the skeleton components to each other reduces a size of the mold. This permits the mold to be horizontally set, to thereby stably hold the cores and the like during a molding operation.

In the illustrated embodiment, the first cores for the arms and legs may each be formed so as to have the portions parallel to each other. This facilitates bending of the first core in one of anteroposterior and lateral (or vertical) directions and renders bending in the other direction difficult, so that the joints of the doll may carry out motion nearer motion of joints of the human body. The first cores may each be bent at both ends thereof, to thereby be substantially prevented from outwardly breaking through the skin/flesh member. Even if the projection occurs, the first core is hard to damage children due to being of both ends, to thereby provide the doll with enhanced safety.

Further, in the illustrated embodiment, as described above, the first cores may each be constituted by the elongated plate-like member, so that a direction of bending of the first core may be restricted to a degree. Also, when the first core is formed to have a coil-like shape, it renders bending thereof at an acute angle difficult, to thereby reduce dependency on the synthetic resin covering it.

Figure 18:
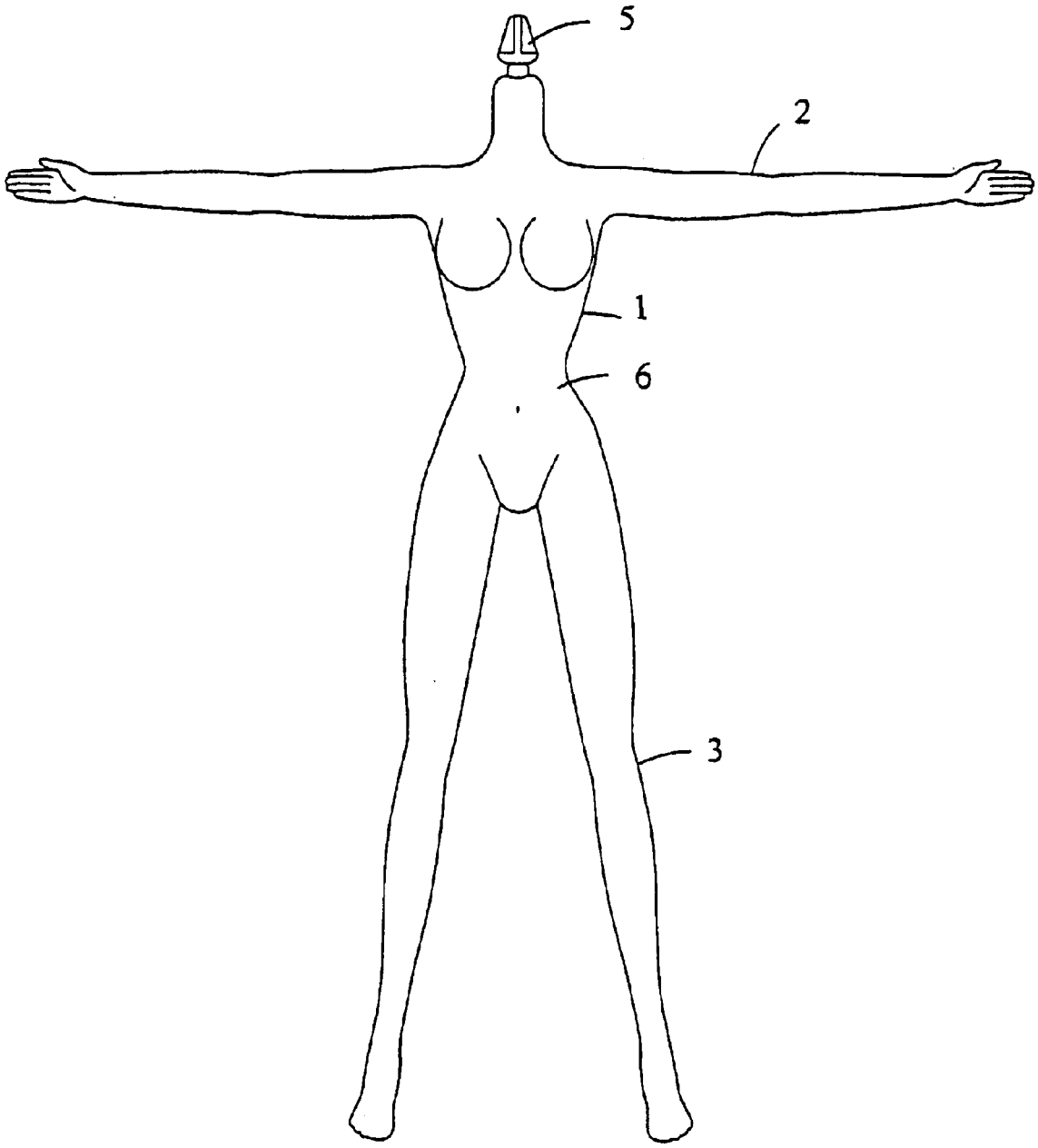
FIG. 18 is a front elevation view showing an elastic doll according to a further embodiment of the present invention.
Figure 19:
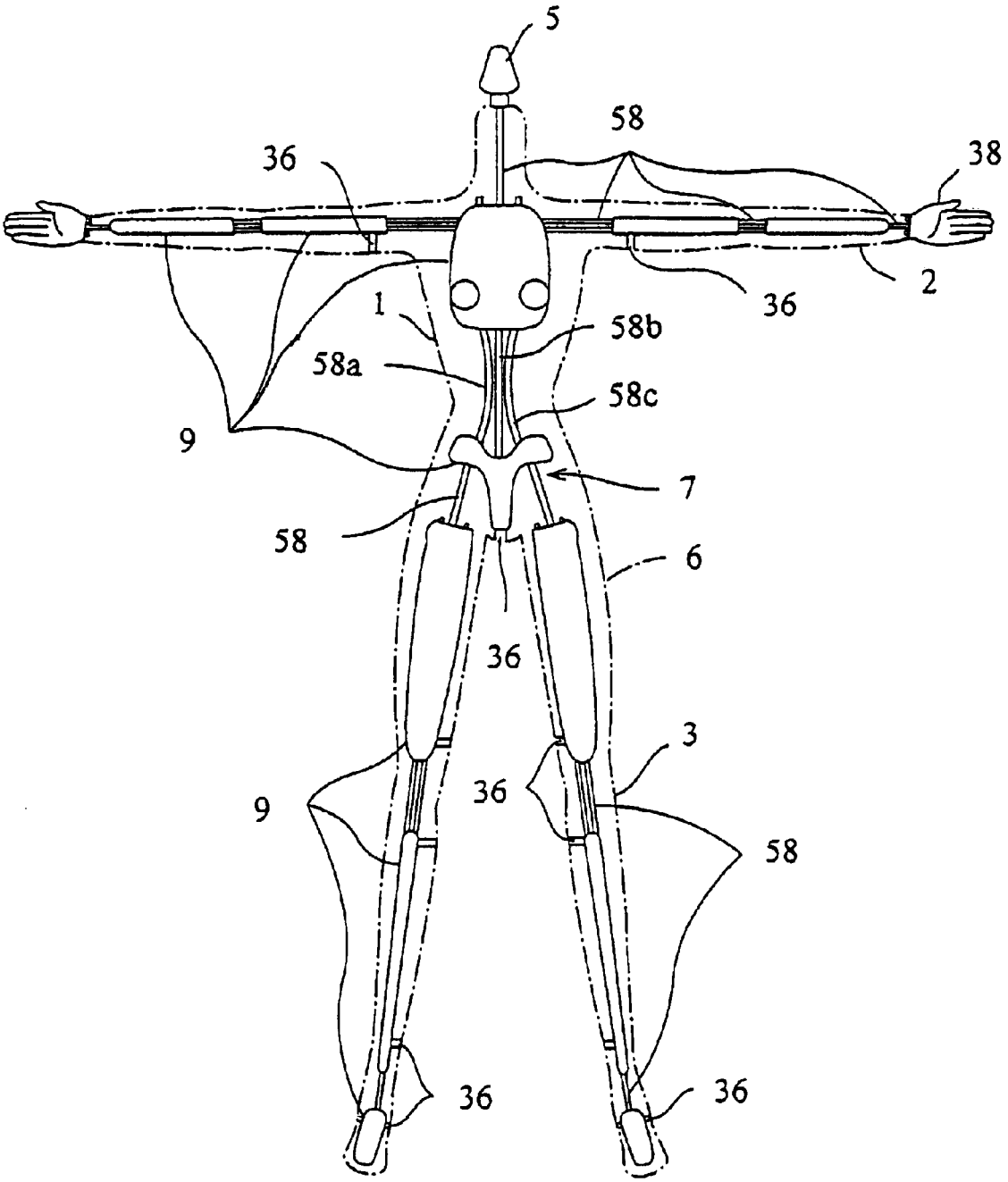
FIG. 19 is a front elevation view showing a skeleton member incorporated in the elastic doll of FIG. 18.
Figure 20:
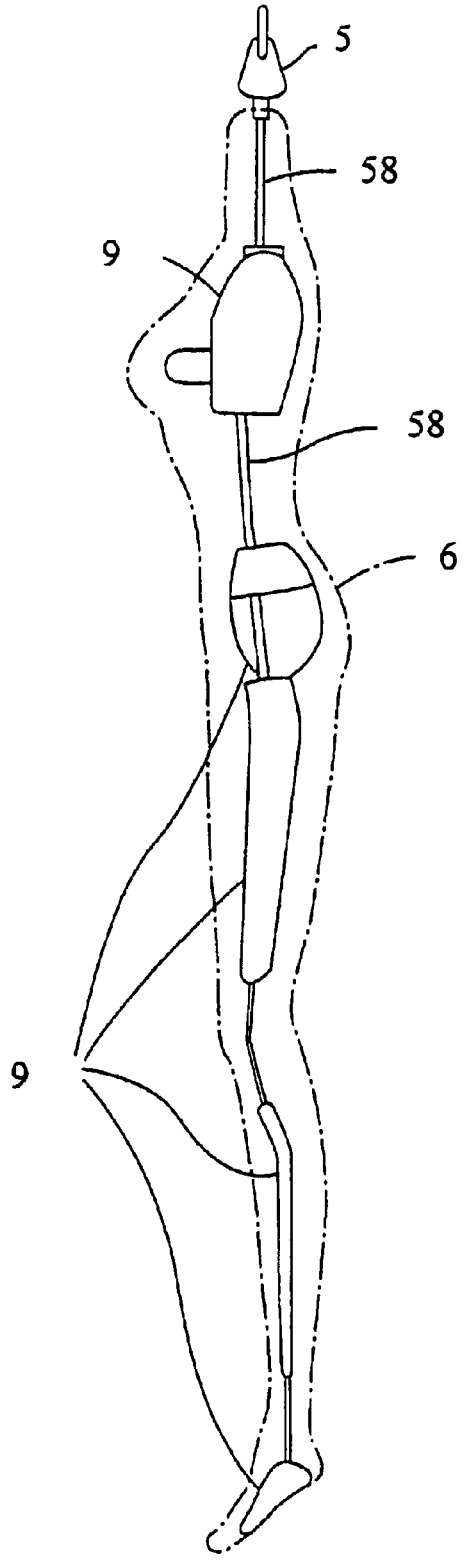
FIG. 20 is a side elevation view of the skeleton member of the elastic doll shown in FIG. 19.

Referring now to FIGS. 18 to 27, a further embodiment of an elastic doll according to the present invention is illustrated, wherein FIG. 18 is a front elevation view of an elastic doll of the illustrated embodiment and FIGS. 19 and 20 are a front elevation view and a side elevation view each showing an internal structure of the elastic doll, respectively. The elastic doll of the illustrated embodiment includes a trunk 1, arms 2 and legs 3. It also includes a neck which is provided on an upper portion thereof with a neck pin 5, on which a head (not shown) is detachably supported. The elastic doll has a surface constituted by a skin/flesh member 6 made of soft synthetic resin, as in the embodiments described above. The skin/flesh member 6 of the elastic doll has a skeleton member 7 embedded therein as shown in FIGS. 19 and 20.

The skeleton member 7 is constructed by integrally connecting first cores 58 made of metal and second cores 9 made of rigid synthetic resin to each other. The first cores 58 are arranged at sites in the doll corresponding to joints and the second cores 9 are arranged at sites in the elastic doll corresponding to distal ends thereof and positions between the joints adjacent to each other.

More specifically, the first cores 58 are each constituted by a wire made of iron, stainless steel or the like and arranged at shoulders, elbows, wrists, a crotch, knees and ankles as well as the neck. Also, the first core 58 is arranged at a center of the trunk 1 and more particularly at a site in the trunk 1 corresponding to a portion of a backbone positioned between a breast and a waist or at a stomach.

The first cores 58 are formed to have diameters different from each other depending on sites in the doll, respectively.

More particularly, the first cores 58 arranged in the neck, trunk, and crotch are formed to have the largest diameter, to thereby be hard to bend at an acute angle, resulting in the first cores being curvedly bent while describing a large arc as in bending of a backbone of the human body. Then, the first core 58 arranged in the neck is formed to have an intermediate diameter. The first cores 58 arranged in the arms 2 and legs 3 are formed to have the smallest diameter, resulting in them being readily bent. Nevertheless, a difference in diameter of the first cores is not limited to the above. It may be suitably determined depending on frequency of bending thereof. Also, it is not necessarily required to arrange the first cores at all sites in the doll corresponding to joints. Thus, they may be arranged at a part of the joints. The first cores 58 are preferably bent at ends thereof to prevent the ends from breaking through the skin/flesh member 6, to thereby be outwardly exposed therefrom.

The trunk 1 has three first cores 58*a*, 58*b* and 58*c* arranged in a portion thereof positioned between the breast and the waist so as to be vertically extended. An outer two of such three first cores which are designated by 58*a* and 58*c* are formed so as to be curved inwardly with respect to each other. Such construction prevents the trunk 1 from extending due to the first core 58*b* formed to be straight and positioned between the first cores 58*a* and 58*c*. Arrangement of the curved first cores 58*a* and 58*c* with the straight first core 58*b* being interposed therebetween permits the trunk 1 to realize all kinds of deformation including "torsion", "anteroposterior bending" and "lateral bending".

The second cores 9 are arranged between the joints. More specifically, the second cores 9 are arranged at sites in the doll corresponding to the breast, upper arms, forearms, the waist, upper legs, lower legs and feet. Thus, the sites at which the second cores 9 are arranged correspond to bones of the human body which are not to be bent, so that the second cores 9 are made of rigid synthetic resin. The rigid synthetic resin is preferably compatible with a material for the skin/flesh member 6 such as a thermoplastic elastomer or the like. Thus, it may be polypropylene or the like. From a viewpoint of compatibility, materials for the skin/flesh member 6 and second core 9 may be selected from elastomers different in hardness from each other, respectively. The reason is that use of a material which is compatible with the skin/flesh member 6 for the second core 9 permits the second core 9 to be integrally coupled to the skin/flesh member 6 during a molding operation, to thereby keeping the second core from giving a feeling different from the skin/flesh member 6. Also, it satisfactorily prevents torsion or dislocation from occurring between the second core 9 and the skin/flesh member 6. In the illustrated embodiment, hands 38 are connected to the skeleton member 7.

Reference numeral 39 designates small projections formed on an end surface of each of the hands 38 defined on a side of the wrist, an end surface of a proximal portion of a second core 9*f* corresponding to each of the upper legs and an upper surface of a second core 9*d* corresponding to each of the shoulders or an upper portion of the chest. Such small projections are preferably formed on other sites in the doll facing the joints as well.

The second cores 9 each have a fixing shaft or shafts 36 formed thereon so as to extend therefrom toward a surface of the elastic doll. More particularly, of the second cores 9, the second cores 9*b* corresponding to the upper arms, second cores 9*f* and 9*g* corresponding to the upper and lower legs and second cores 9*i* corresponding to the feet are each formed on a lateral portion thereof with the fixing shaft or shafts 36. Also, a second core 9*e* corresponding to the waist is provided thereon with the fixing shaft 36 so as to downwardly extend therefrom. The fixing shafts 36 are each arranged so as to extend to the surface of the doll. The fixing shafts 36 are each subjected to a hot shot treatment using hot air, to thereby be integrated with the skin/flesh member 6 therearound and smoothly finished.

Figure 21:
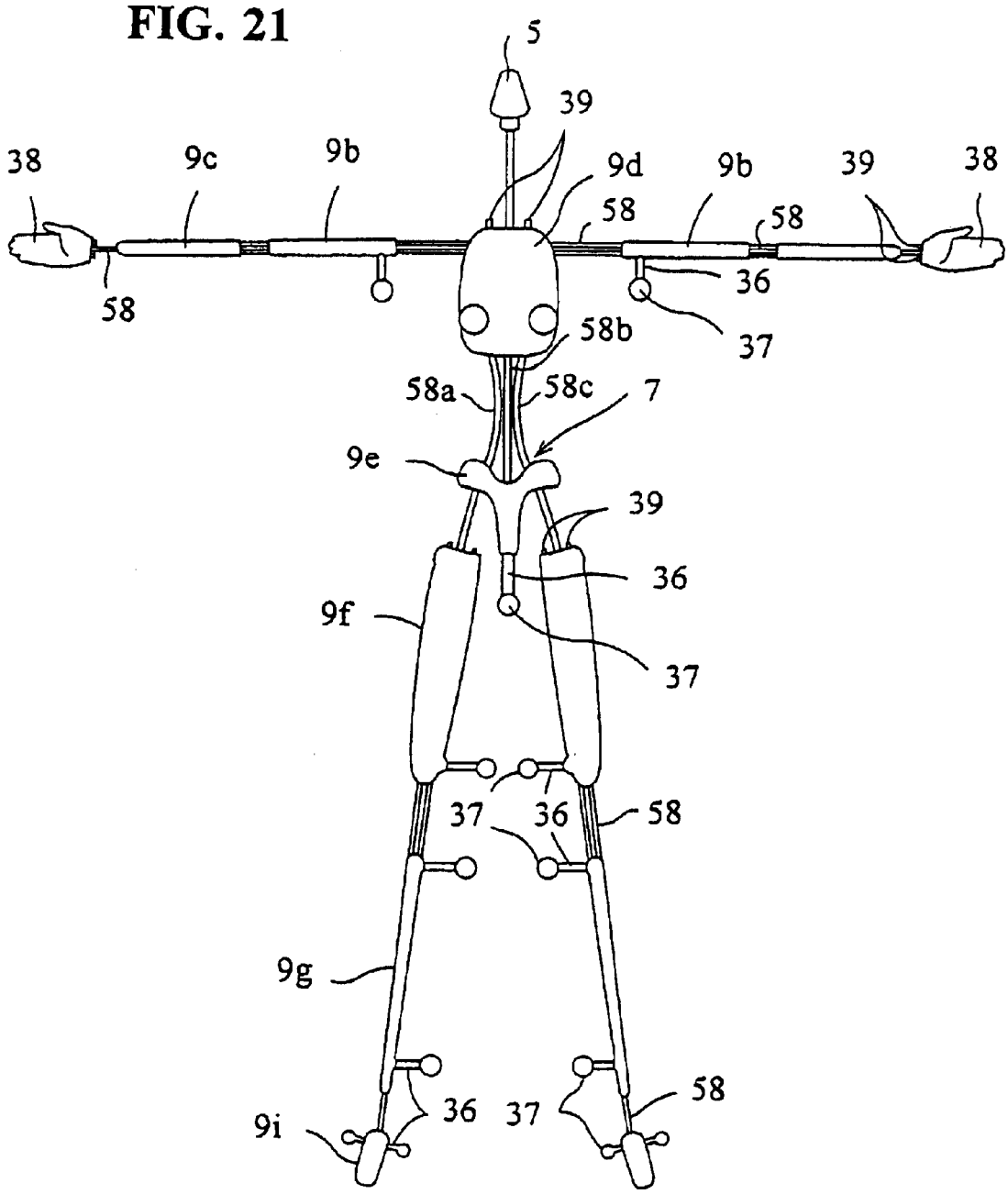
FIG. 21 is a front elevation view of the skeleton member shown in FIG. 19 prior to molding.
Figure 22:
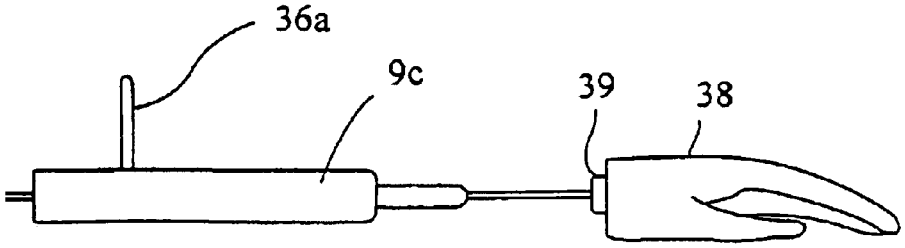
FIG. 22 is an enlarged view showing an essential part of a fixing shaft of a forearm.

The fixing shafts 36 each have an increased length and are provided at a distal end thereof with an expanded projection 37 of a frust-conical shape as shown in FIGS. 21 and 22, before they are subjected to a molding operation. Also, of the fixing shafts, fixing shafts 36*a* (FIG. 22) of second cores 9*c* at sites in the doll corresponding to the forearms are arranged so as to rearwardly extend therefrom and formed to have the same diameter. The other fixing shafts 36 are each formed with the expanded projection 37. The fixing shaft 36*a* of the second core 9*c* at the site in the doll corresponding to each of the forearms functions to more securely hold the core in the mold. Thus, arrangement of the fixing shaft 36*a* is not necessarily required.

Figure 23A:
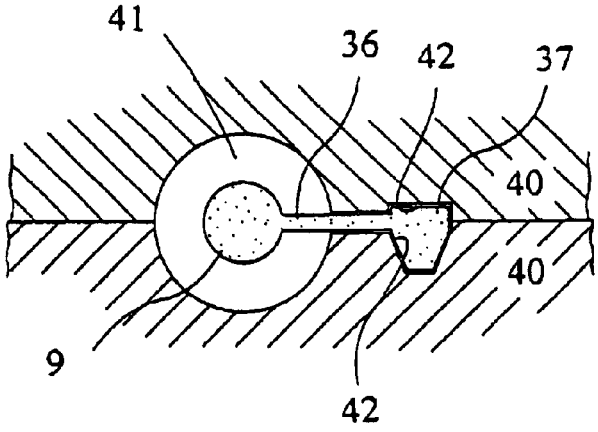
FIGS. 23A, 23B and 23C each are a sectional view showing a respective one of skeleton components received in molding spaces.
Figure 23B:
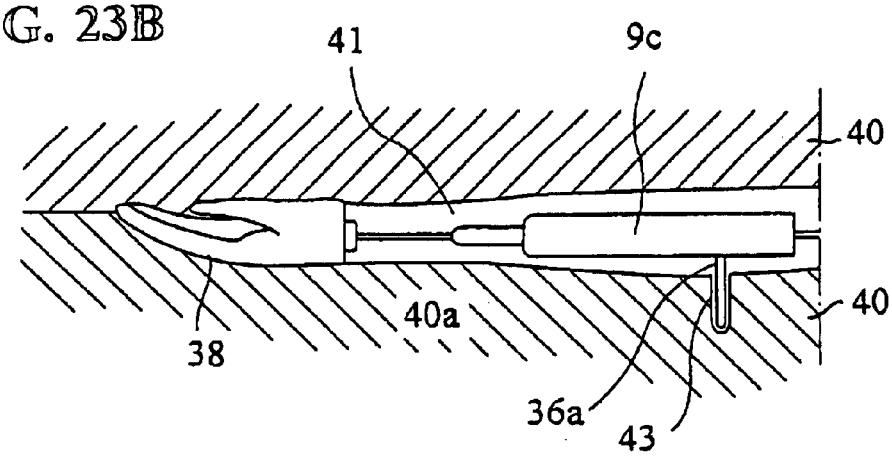
Figure 23C:
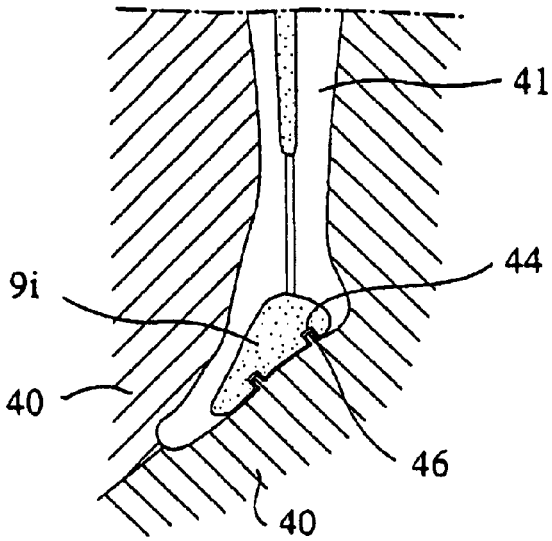

The above-described second core 9*i* at the site in the doll corresponding to each of the feet is exposed on a surface thereof corresponding to a sole of the foot from the sole and formed on the exposed surface with small holes 44 as shown in FIG. 23C.

Now, a manner of molding of the thus-constructed elastic doll will be described by way of example. First of all, as shown in FIGS. 23A and 23B, a split mold 40 which is formed therein with a molding space 41 is provided. The split mold has mating surfaces defined around the molding space 41. The mating surfaces are each formed with fit grooves 42 in which the respective fixing shafts 36 provided with the expanded projections 37 are fitted. Also, one mold member 40*a* of the split mold 40 is formed on a bottom surface of the molding space 41 thereof with a fit hole 43 for the fixing shaft 36*a* of the second core 9*c* at the site in the doll corresponding to each of the forearms. Such construction permits the fixing shafts 36 and 36*a* of the skeleton member 7 to be fitted in the corresponding fit grooves 42 and fit holes 43, respectively. Also, the hands 38 are each received in a space formed in the mold so as to be positioned outside the molding space 41. Further, as shown in FIG. 23C, the second core 9*i* corresponding to each of the feet is directly abutted on a rear surface thereof against an inner surface of the molding space 41. The inner surface of the molding space 41 is provided thereon with fixing pins 46 so as to inwardly extend therefrom. Such construction permits the portions of the skeleton member 7 corresponding to the legs to be firmly held in place while being floated in the molding space 41.

Figure 24:
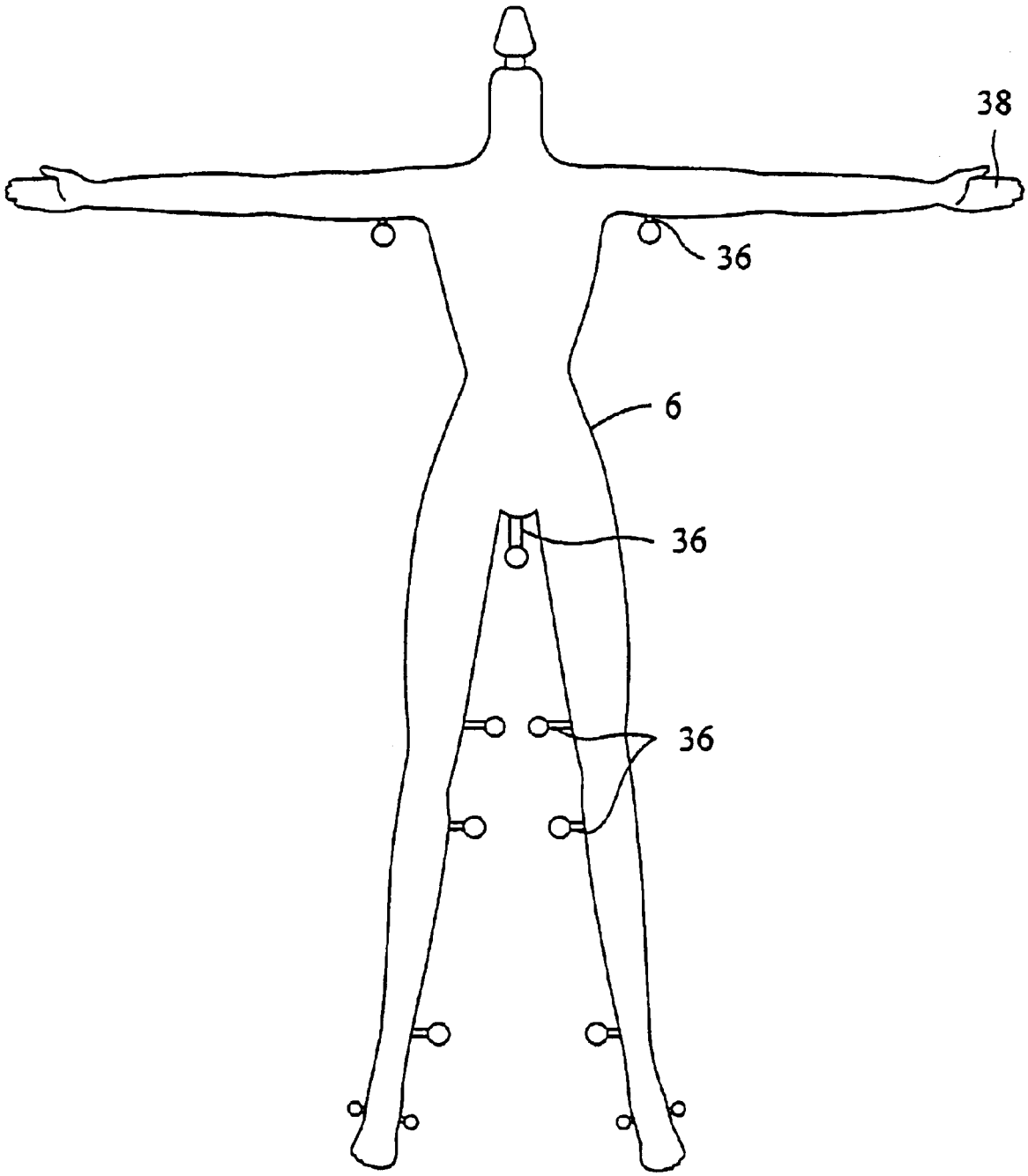
FIG. 24 is a front elevation view showing a semi-finished product immediately after molding.

After the mold 40 is closed, a molding material (soft synthetic resin such as thermoplastic elastomer or the like) is injected through runners into the molding space 41. The molding material preferably has the same color as the second cores 9. Although an injection pressure of the molding material is increased, the skeleton member 7 is firmly held in the molding space 41, to thereby be prevented from moving during a molding operation. After the molding space 41 is filled with the molding material, the mold 40 is opened, so that a semi-finished product wherein the skeleton member 7 is covered with the skin/flesh member 6 and the fixing shafts 36 and 36*a* are projected from the surface of the elastic doll may be obtained as shown in FIG. 24. In the illustrated embodiment, the skin/flesh member 6 is made of a thermoplastic elastomer and the hands 38 and second cores 9 are made of polypropylene. Both materials are compatible with each other, so that the members are melted together, to thereby be integrated with each other.

Figure 25:
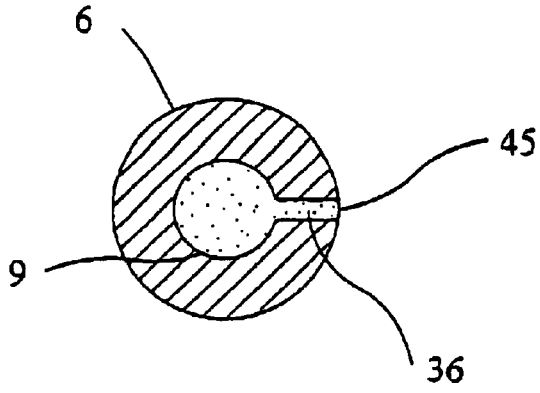
FIG. 25 is a cross-sectional view showing a cut surface of a fixing shaft.
Figure 26:
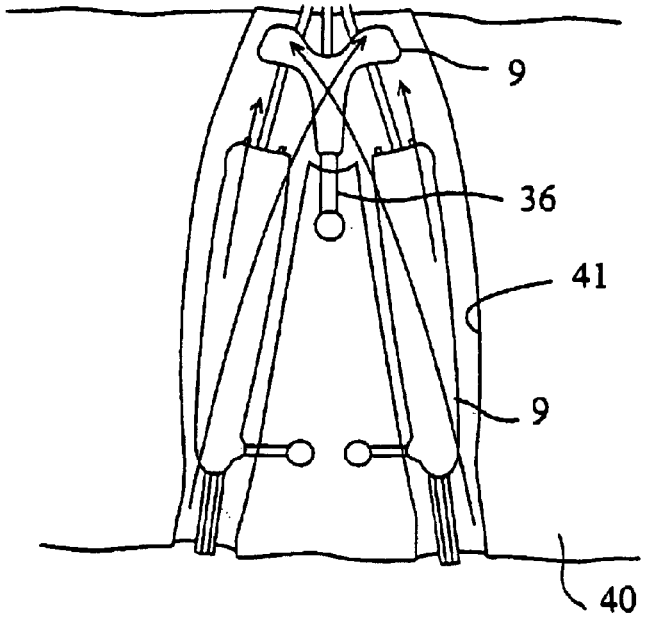
FIG. 26 is a schematic view of an essential part of a mold showing flowing of molten resin injected from portions of the mold corresponding to legs of a doll into the mold.

Then, the fixing shafts 36 and 36*a* are removed from the semi-finished product by cutting. Removal of the fixing shafts 36 and 36*a* causes marks (cut surfaces) 45 to be left on the surface of the doll as shown in FIG. 25. Thus, the marks 45 are treated so as to render the whole surface of the doll smooth. This may be carried out by melting a portion of the skin/flesh member surrounding each of the marks, to thereby render the surface smooth. More specifically, the portion of the skin/flesh member is melted by a hot shot treatment using hot air, to thereby plug the marks 45, resulting in the surface being smoothed. The thermoplastic elastomer on an outer side of the doll and the second cores 9 on an inner side thereof are compatible with each other as described above, so that both are melted with each other by heating, to thereby be integrated together, so that the marks 45 may be smoothly plugged. Alternatively, the fixing shafts 36 and 36*a* may be removed by breaking rather than the above-described cutting.

The second core 9*i* corresponding to each of the feet of the doll, as described above, is externally exposed on the rear surface thereof. However, the rear surface is normally covered with each of socks, to thereby be out of sight, resulting in it being ignored. Alternatively, it is of course that the rear surface may be melted together with the sole of the foot by a hot shot treatment, to thereby be integrated with each other.

In the case that injection of the soft synthetic resin into the mold 40 is carried out by feeding the molten molding material from places on the mold corresponding to tips of the feet of the doll toward a portion of the molding space 41 corresponding to the trunk 1, an injection pressure of the molding material is rendered unstable when streams of the molding material are merged together in the trunk 1, so that flowing of the molding material is complicated, to thereby cause force at a magnitude sufficient to lead to vigorous vibration of the skeleton member 7 to be applied thereto. Nevertheless, the second core 9 positioned at the waist at which the streams are merged with each other is provided with the fixing shaft 36, to thereby permit the skeleton member 7 to be firmly stably held in the molding space 41, resulting in the vibration being prevented. In addition to the legs, the second core may be provided at a site thereon at which it is bifurcated with the fixing shaft 36, because the site causes an injection pressure of the molding material to be unstable.

Figure 27:
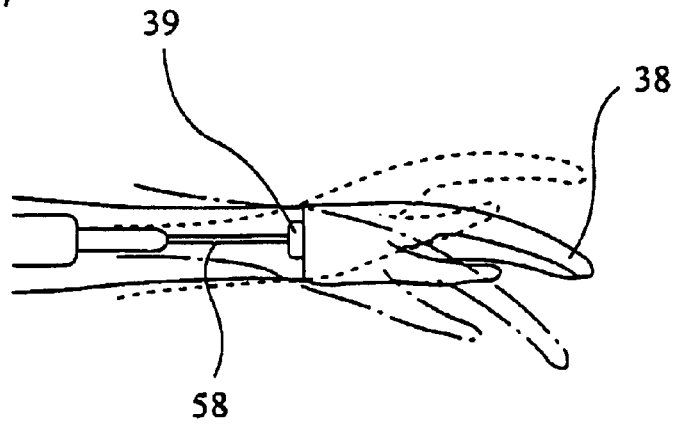
FIG. 27 is a schematic view showing movement of a skin/flesh member when a wrist is moved.

Further, as described above, the small projections 39 are arranged on the end surface of each of the hands 38 facing the wrist, the end surface of the proximal portion of the second core 9*f* corresponding to each of the upper legs and the upper surface of each of the second cores 9*d* corresponding to the shoulders so as to outwardly project therefrom, wherein these portions are At solidly covered therearound with the skin/flesh member 6. Thus, when, for example, the wrist is bent, the small projections 39 as well as the wrist are permitted to be moved as shown in FIG. 27, so that a portion of the skin/flesh member 6 positioned around the small projections 39 may be likewise moved. This prevents the first core 58 made of metal and corresponding to the wrist from being violently bent. This prevents stress from being concentrated at a part of the first core 58, so that it may be kept from breakage when the bending of the wrist is repeatedly carried out. Arrangement of the small projections 39 on the proximal portion of each of the legs 3 and the upper surface of each of the shoulders is due to the same reason.

In the illustrated embodiment, the fixing shafts are arranged so as to extend from the second cores made of rigid synthetic resin and constituting the skeleton member toward the surface of the doll. Also, the material for the fixing shafts are compatible with soft synthetic resin for the skin/flesh member arranged so as to cover the cores. Thus, when the fixing shafts are outwardly exposed at the end surfaces thereof, they are melted to smoothly treat the surface of the doll. Further, the fixing shafts may be exposed from the surface of the doll. Thus, the fixing shafts may be extended to securely hold the cores in the mold, resulting in the skeleton member being held at a center in the respective sites in the doll during a molding operation. In the illustrated embodiment, the skeleton member is exposed at the portion thereof corresponding to the sole of each of the feet from the sole, so that the portion may be used for fixing the skeleton member in the mold during molding.

In particular, in the illustrated embodiment, as described above, the skeleton member is securely held in the mold by the fixing shafts, whereby the skeleton member is held at a center in the respective sites in the doll. This prevents the core from being exposed from the surface of the elastic doll and the core from being deviated from a center in each of the sites in the doll to a degree sufficient to cause unnatural bending of the site, leading to an increase in yields. In addition, the illustrated embodiment is so constructed that each of the fixing shafts is removed at a portion thereof projected from the surface of the doll after the molding and a portion of the fixing shaft left on the surface of the doll due to the removal is treated so as to be cleared from the surface. This prevents a deterioration in commercial value of the finished product.

Also, in the embodiment, the marks left on the surface of the doll due to removal of the fixing shafts are treated by melting the surface of the doll, so that the surface of the doll may be smoothed while the cut surfaces are neatly plugged or treated. Further, in the case that the core is directly abutted at the rear surface of the distal end thereof corresponding to each of the feet against the inner surface of the molding space, the portion of the skeleton corresponding to the foot is firmly held at a predetermined position in the molding space when the mold is closed.

Further, in the embodiment, the skeleton member is constituted by the first cores made of metal and arranged at the sites in the doll corresponding to the joints and the second cores made of rigid synthetic resin and arranged at the sites therein corresponding to the distal ends thereof and positions between the joints adjacent to each other, so that the doll may be bent at the same sites as joints of the human body, to thereby exhibit enhanced reality. Furthermore, the trunk has three of the first cores arranged therein so as to be vertically extended, of which the outer two are curved inwardly with respect to each other. Such construction prevents the trunk from being extended over the central first core. Curving of the outer two first cores permits the trunk to realize all kinds of deformation including "torsion", "anteroposterior bending" and "lateral bending".

Moreover, in the illustrated embodiment, the small projections are arranged on the portion of each of the second cores facing the joint, so that bending of the joint permits the portion to be moved, so that a portion of the skin/flesh member positioned around the small projections may be likewise moved. This prevents the wrists, legs and neck from being violently bent, to thereby be kept from breakage when the bending of the portion is repeatedly carried out. In addition, the fixing shafts are arranged at the sites in the doll at which an injection pressure of soft synthetic resin is rendered unstable during injection of the resin into the mold, so that the skeleton member may be stably held in the molding space.

What is claimed is:

1. A method for manufacturing an elastic doll comprising the steps of:

insert molding second cores on each of flexible first cores so as to be spaced from each other using a skeleton forming material of a rigid synthetic resin, to thereby form a skeleton member including said first and second cores connected to each other; and insert molding a skin/flesh member on said skeleton member using a skin/flesh forming material of a soft synthetic resin whereby the rigid synthetic resin and the soft synthetic resin are compatibly welded together.

2. A method for manufacturing an elastic doll as defined in claim 1, wherein said skeleton forming material is polyolefin resin and said skin/flesh forming material is an elastomer.

3. A method for manufacturing an elastic doll as defined in claim 1 wherein the elastic doll includes a trunk, arms and legs in which said skeleton member is embedded;

said step of insert molding said second cores includes forming fixing shafts which extend from said second cores to a surface of the doll; and said step of insert molding said skin/flesh member includes arranging said skeleton member in a mold for molding the skin/flesh member, fixing said fixing shafts on mating surfaces of said mold to stabilize said skeleton member and injecting the soft synthetic resin into said mold, further comprising the steps of removing portions of said fixing shafts projected from the surface of the doll after molding and treating marks left on the surface of the doll due to removal of the projected portions of said fixing shafts.

4. A method for manufacturing an elastic doll as defined in claim 3, wherein said step of treating said marks is carried out by melting the surface of the doll.

5. A method for manufacturing an elastic doll as defined in claim 3, wherein said skeleton member includes a foot skeleton section incorporated in each of said legs; and said step of insert molding said skin/flesh member includes directly abutting a rear surface of a distal end of each of said second cores corresponding to said foot skeleton section against an inner surface of molding spaces in the mold, to thereby securely hold said second cores therein.

6. A method for manufacturing an elastic doll as defined in claim 3, wherein said first cores are each made of metal;

said skeleton member is constituted by said first cores which are arranged at sites in the doll corresponding to joints and said second cores which are arranged at sites in the doll corresponding to distal ends thereof and positions between joints adjacent to each other; and said trunk includes three of said first cores arranged therein so as to be vertically extended;

an outer two of said three first cores being inwardly curved with respect to each other.

7. A method for manufacturing an elastic doll as defined in claim 3, wherein said second cores are formed at a place thereon facing a joint with small projections.

8. A method for manufacturing an elastic doll as defined in claim 3, wherein said fixing shafts are each arranged at a site in the doll at which an injection pressure of the soft synthetic resin is unstable when the soft synthetic resin is injected into said mold.

9. A method for manufacturing an elastic doll which includes a trunk, arms and legs in which a skeleton member is embedded, comprising the steps of:

providing cores made of rigid synthetic resin to constitute said skeleton member wherein fixing shafts are formed to extend from said cores to a surface of the doll;

arranging said skeleton member in a mold and fixing said fixing shafts on mating surfaces of said mold to stabilize said skeleton member;

injecting soft synthetic resin into said mold; and removing portions of said fixing shafts projected from the surface of the doll after molding and treating marks left on the surface of the doll due to removal of the projected portions of said fixing shafts, the soft synthetic resin and rigid synthetic resin are welded together within the mold.

10. A method for manufacturing an elastic doll as defined in claim 9, wherein said treating of said marks is carried out by melting the surface of the doll.

11. A method for manufacturing an elastic doll as defined in claim 9, wherein said skeleton member includes a foot skeleton section incorporated in each of said legs; and a rear surface of a distal end of each of said cores corresponding to said foot skeleton section is directly abutted against an inner surface of molding spaces in the mold, to thereby be securely held therein.

12. A method for manufacturing an elastic doll as defined in claim 9, wherein said skeleton member is constituted by first cores made of metal and arranged at sites in the doll corresponding to joints and second cores made of rigid synthetic resin and arranged at sites in the doll corresponding to distal ends thereof and positions between joints adjacent to each other; and said trunk includes three of said first cores arranged therein so as to be vertically extended;

an outer two of said three first cores being inwardly curved with respect to each other.

13. A method for manufacturing an elastic doll as defined in claim 9, wherein the cores of said skeleton member are formed at a place thereon facing a joint with small projections.

14. A method for manufacturing an elastic doll as defined in claim 9, wherein said fixing shafts are each arranged at a site in the doll at which an injection pressure of the soft synthetic resin is unstable when the soft synthetic resin is injected into said mold.

15. A method for manufacturing an elastic doll as defined in claim 1 wherein the elastic doll includes a trunk, arms and legs in which said skeleton member is embedded;

said step of insert molding said second cores includes forming fixing shafts which extend from said second cores to a surface of the doll; and said step of insert molding said skin/flesh member includes arranging said skeleton member in a mold for molding the skin/flesh member, fixing said fixing shafts on mating surfaces of said mold to stabilize said skeleton member and injecting the soft synthetic resin into said mold, further comprising the steps of removing portions of said fixing shafts projected from the surface of the doll after molding and treating marks left on the surface of the doll due to removal of the projected portions of said fixing shafts by a hot air procedure to melt the surface adjacent the marks and the flexible first cores are formed of one of a stainless steel and iron fixedly attached to the second cores.

16. A method of forming a doll with simulated bending appendages to simulate a living creature, comprising:

forming a metal frame;

covering the metal frame with a first synthetic resin material with a first hardness value to limit bending of the metal frame;

molding a plurality of rigid core sections at positions spaced along the covered metal frame while exposing the covered metal frame in positions corresponding to anatomical joints of the living creature; and molding a second soft synthetic resin having a second hardness value to surround the covered metal frame and the plurality of rigid core sections to simulate the tissue of the living creature, the first hardness value is greater than the second hardness value and wherein the first synthetic resin, and the second synthetic resin are formed of compatible thermoplastic elastomers to weld together when contacting each other in a mold.

17. The method of forming a doll as defined in claim 16 wherein the metal frame includes a plurality of wire members bent to provide a pair of substantially parallel portions extending from a bent intermediate section.

18. The method of forming a doll as defined in claim 16 wherein the metal frame is principally formed of iron.

19. The method of forming a doll as defined in claim 18 wherein the metal frame is held magnetically during the molding steps.

20. The method of forming a doll as defined in claim 16 wherein the rigid core sections are molded of a polyolefin resin and the second soft synthetic resin is an elastomer.

21. The method of forming a doll as defined in claim 16 wherein the rigid core sections are molded of a polypropylene and the second soft synthetic resin is a styrene elastomer.

22. The method of forming a doll as defined in Class 21 wherein the first synthetic resin material is a styrene elastomer.

* * * * *